US008573593B2

(12) United States Patent
Shiraishi

(10) Patent No.: US 8,573,593 B2
(45) Date of Patent: Nov. 5, 2013

(54) IMAGE FORMING APPARATUS

(75) Inventor: Yoshinori Shiraishi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/368,102

(22) Filed: Feb. 7, 2012

(65) Prior Publication Data

US 2012/0200028 A1 Aug. 9, 2012

(30) Foreign Application Priority Data

Feb. 8, 2011 (JP) ..... 2011-025281

(51) Int. Cl.
*B65H 7/02* (2006.01)

(52) U.S. Cl.
USPC ..... 271/258.01; 271/259; 399/18; 399/21; 399/19

(58) Field of Classification Search
USPC ..... 271/258.01, 259, 258.03; 399/21, 18, 399/19
See application file for complete search history.

(56) References Cited

U.S. PATENT DOCUMENTS

| | | | | |
|---|---|---|---|---|
| 5,893,657 | A | 4/1999 | Matsuzawa | |
| 6,775,486 | B2 * | 8/2004 | Matsuyama et al. | 399/21 |
| 7,085,504 | B2 * | 8/2006 | Matsuyama et al. | 399/21 |

FOREIGN PATENT DOCUMENTS

| | | | |
|---|---|---|---|
| JP | 6-219598 | A | 8/1994 |
| JP | 2002-052769 | A | 2/2002 |
| JP | 2005-263347 | A | 9/2005 |
| JP | 2007-316174 | A | 12/2007 |

* cited by examiner

*Primary Examiner* — Luis A Gonzalez
(74) *Attorney, Agent, or Firm* — Birch, Stewart, Kolasch & Birch, LLP

(57) ABSTRACT

An image forming apparatus includes a unit that detects the position of a sheet in a sheet transport path when jamming is detected, a forced moving processing unit that, when jamming is detected and rotational driving of sheet transport rollers is stopped, based on the position of the sheet in the sheet transport path, performs forced moving processing in which the sheet is transported so as to forcibly move the sheet to a sheet removal position, and a forced moving processing determination unit that determines whether the forced moving processing is to be performed by the forced moving processing unit in accordance with the position of the sheet that was detected by the sheet position detection unit.

10 Claims, 15 Drawing Sheets

FIG.10

Sheet size

| Size | Length (mm) Horizontal | | Vertical |
|---|---|---|---|
| A3 | 297 | × | 420 |
| B4 | 257 | × | 364 |
| A4 | 210 | × | 297 |
| B5 | 182 | × | 257 |
| A5 | 148 | × | 210 |
| B6 | 128 | × | 182 |

IMAGE FORMING APPARATUS

CROSS-REFERENCE TO RELATED APPLICATION

This application claims priority under 35 U.S.C. §119(a) on Patent Application No. 2011-025281 filed in Japan on Feb. 8, 2011, the entire contents of which are herein incorporated by reference.

BACKGROUND OF THE INVENTION

1. Field of the Invention

The present invention relates to an image for forming apparatus in which the rotational driving of sheet transport rollers by a driving portion is stopped in the case where sheet jamming has been detected.

2. Description of the Related Art

An image forming apparatus such as a printer, a copy machine, or a compound machine generally has a configuration in which multiple sheet transport rollers are provided along a sheet transport path for guiding a sheet such as printing paper along a sheet transport direction, the transport timing of a sheet transported in the sheet transport path by the sheet transport rollers, which are rotationally driven by a driving portion, is detected, and sheet jamming is detected using the detected transport timing.

FIG. 14 is an illustrative diagram schematically showing the state in which a sheet B is transported from a sheet storage portion A1 toward a photosensitive drum A2 in a conventional image forming apparatus AA.

As shown in FIG. 14, the conventional image forming apparatus AA in which multiple sheet transport rollers A4 are provided along a sheet transport path A3 generally has a configuration in which, in the case where jamming (sheet jamming) of a sheet B that is transported in a sheet transport direction Y is detected using the transport timing detected by a sheet detection portion A5, the rotational driving of sheet transport rollers A4 by a driving portion A6 is stopped.

Also, a sheet removal job region α for removing the sheet B that was motionless when jamming was detected (e.g., a region for removing the sheet B that was motionless when jamming was detected by releasing an access cover A7 in the sheet transport path A3) is provided at one or more places in the sheet transport path A3.

FIGS. 15A and 15B are schematic perspective diagrams for describing the sheet removal job for removing the sheet B that was motionless when jamming was detected. FIG. 15A shows a state during the release of the access cover A7, and FIG. 15B shows a state in which the access cover A7 is released and the sheet B that was motionless when jamming was detected is being removed.

As shown in FIGS. 15A and 15B, the access cover A7 is configured so as to open and close the sheet removal job region α in the sheet transport path A3 for removing the sheet B. Specifically, the access cover A7 is able to slide with respect to an apparatus main body A0 of the image forming apparatus AA in a width direction W that is orthogonal to the axial direction of the sheet transport rollers A4 (depth direction X) and the vertical direction Z.

In the case where jamming of the sheet B has occurred in the image forming apparatus AA, a user releases the access cover A7 (see FIG. 15A) in order to remove the sheet B that was motionless when jamming was detected, and removes the sheet B that is visible when the access cover A7 is in the released state (see FIG. 15B).

However, depending on the position of the sheet B that was motionless when jamming was detected, there are cases where the sheet B is not visible even when the access cover A7 is released (i.e., the sheet B is not present in the sheet removal job region α in the sheet transport path A3 and cannot be found).

FIG. 16 is a schematic perspective diagram showing the state in which the sheet B that was motionless when jamming was detected is not visible even when the access cover A7 is released.

As shown in FIG. 16, in the case where the sheet B that was motionless when jamming was detected is not visible even when the access cover A7 is released, the user does not know where the sheet B is located, and therefore the recovery job for removing the sheet B and restarting the image forming operation becomes time-consuming.

Particularly in the case where the sheet removal job region α is provided at multiple places, and a consecutive image forming operation is performed for consecutively performing image formation on multiple sheets, the above-described problem becomes increasingly significant as the inter-sheet distance between a preceding sheet and a successive sheet decreases and the number of jammed sheets increases.

In view of this, as forced moving processing in which a sheet that was motionless when jamming was detected is forcibly moved to a predetermined position, JP 2007-316174A (hereinafter, referred to as Patent Document 1) discloses a configuration in which, in the case where the occurrence of jamming is detected, and the leading edge of a sheet has stopped between an image carrier and a fixing apparatus, the sheet is forcibly transported until a detecting means, which is for detecting whether a sheet has passed through a pair of registration rollers, has detected the passage of the trailing edge of the sheet.

However, in the configuration disclosed in Patent Document 1, forced moving processing is performed regardless of where the sheet that was motionless when jamming was detected is located in the sheet transport path in the sheet transport direction (e.g., even if the motionless sheet is present in a sheet removal job region in the sheet transport path), and therefore forced moving processing is sometimes needlessly performed. Also, even when forced moving processing is performed on a motionless sheet, the sheet is simply forcibly transported until the passage of the trailing edge of the sheet is detected by the detecting means, and it is not always true that the sheet becomes located in a sheet removal job region in the sheet transport path.

In view of this, an object of the present invention is to provide an image forming apparatus that can avoid the needless execution of forcible moving processing and can reliably cause a sheet that was motionless when jamming was detected to be located in a sheet removal job region in a sheet transport path.

SUMMARY OF THE INVENTION

In order to solve the above-described issues, the present invention provides an image forming apparatus including: a sheet transport path that guides a sheet along a sheet transport direction; a plurality of sheet transport rollers provided along the sheet transport path in order to transport the sheet in the sheet transport direction in the sheet transport path; a driving portion that rotationally drives the sheet transport rollers; a sheet detection portion that detects a transport time of the sheet that is transported in the sheet transport path by the sheet transport rollers that are rotationally driven by the driving portion; and a control portion that stops rotational driving of the sheet transport rollers by the driving portion in a case where jamming of the sheet has been detected using the transport time detected by the sheet detection portion, wherein a sheet removal job region for removal of the sheet that was motionless when the jamming was detected is provided in the sheet transport path, and the control portion includes: a sheet position detection unit that detects the position of the sheet in the sheet transport path in the sheet transport direction when the jamming was detected; a forced moving processing unit that, in a case where the jamming is detected and rotational driving of the sheet transport rollers by the driving portion is stopped, based on the position of the sheet in the sheet transport path in the sheet transport direction that was detected by the sheet position detection unit, performs forced moving processing in which the sheet is transported so as to forcibly move the sheet to a sheet removal position at which at least part of the sheet is located in the sheet removal job region; and a forced moving processing determination unit that determines whether the forced moving processing is to be performed by the forced moving processing unit in accordance with the position of the sheet in the sheet transport path in the sheet transport direction that was detected by the sheet position detection unit.

According to the present invention, whether the forced moving processing is to be performed by the forced moving processing unit is determined in accordance with the position of the sheet in the sheet transport path in the sheet transport direction that was detected by the sheet position detection unit, thus enabling performing the forced moving processing in the case where it has been detected that at least part of the sheet was not located in the sheet removal job region in the sheet transport path when the jamming was detected, and not performing the forced moving processing in the case where at least part of the sheet was located in the sheet removal job region in the sheet transport path when the jamming was detected. This makes it possible to avoid performing needless forced moving processing. Moreover, in the case where jamming is detected and the rotational driving of the sheet transport rollers by the driving portion is stopped when the forced moving processing is to be performed, based on the position of the sheet in the sheet transport path in the sheet transport direction that was detected by the sheet position detection unit, the sheet is transported so as to forcibly move the sheet to a sheet removal position at which at least part of the sheet is located in the sheet removal job region, thus enabling reliably causing the sheet that was motionless when the jamming was detected to be located in the removal job region in the sheet transport path.

In the present invention, a consecutive image forming operation for consecutively performing image formation on a plurality of the sheets may be performed. In this case, it is preferable that when the sheet is to be transported in the sheet transport direction toward the sheet removal position in the forced moving processing performed by the forced moving processing unit, the sheet removal position is set to a position at which a downstream side edge (leading edge) of the sheet in the sheet transport direction is disposed on the upstream side of an upstream side edge (trailing edge) in the sheet transport direction of a nearest sheet that is motionless ahead of the sheet.

According to this feature, in the case where the consecutive image forming operation is to be performed, even if the forced moving processing is performed by the forced moving processing unit, the downstream side edge of the sheet in the sheet transport direction (leading edge) will not arrive at the upstream side edge in the sheet transport direction (trailing edge) of the nearest sheet that is ahead, thus enabling avoiding a collision between the sheet and the nearest sheet that is ahead.

In the present invention, a configuration is possible in which the sheet position detection unit detects the position of the sheet in the sheet transport path in the sheet transport direction based on a transport distance of the sheet calculated using a jamming detection time that is from a detection time at a reference detection position to the time when the jamming was detected, the reference detection position serving as a reference detection position of the transported sheet on the upstream side of the sheet removal job region in the sheet transport path.

According to this feature, the transport distance of the sheet can be easily obtained by calculation using the jamming detection time from the detection time at the reference detection position to the time when the jamming was detected and the sheet transport speed. Also, the position of the sheet in the sheet transport path in the sheet transport direction when the jamming was detected can be easily detected by calculation using the reference detection position and the transport distance.

In the present invention, a configuration is possible in which the forced moving processing unit forcibly moves the sheet a moving distance obtained by subtracting the transport distance from a reference distance that is from the reference detection position to the sheet removal position.

According to this feature, in the case where the forced moving processing is to be performed by the forced moving processing unit, the sheet can be accurately caused to stop at the sheet removal position by forcibly moving the sheet the moving distance obtained by subtracting the transport distance from the reference distance, which is from the reference detection position to the sheet removal position.

In the present invention, a configuration is possible in which a first reference detection position at which the sheet is detected on the upstream side of the sheet removal job region in the sheet transport direction, and a second reference detection position at which the sheet is detected between the first reference detection position and the sheet removal job region are included as the reference detection position, the forced moving processing determination unit determines that the forced moving processing is not to be performed by the forced moving processing unit in a case where the jamming was detected before a downstream side edge (leading edge) of the sheet in the sheet transport direction arrives at the first reference detection position, the forced moving processing determination unit determines that the sheet is to be transported toward the sheet removal position in the sheet transport direction in the forced moving processing performed by the forced moving processing unit in a case where the jamming was detected before the downstream side edge (leading edge) of the sheet in the sheet transport direction arrives at a pre-set setting position that is between the first reference detection position and an upstream side edge of the sheet removal job region in the sheet transport direction, and the forced moving processing determination unit determines that the forced moving processing is not to be performed by the forced moving processing unit in a case where the jamming was detected at a time that is after the downstream side edge (leading edge) of the sheet in the sheet transport direction arrived at the upstream side edge of the sheet removal job region in the sheet transport direction and before an upstream side edge (trailing edge) of the sheet in the sheet transport direction passes the sheet removal job region.

According to this feature, the forced moving processing is performed only when necessary in conformity with the arrangement configuration of the constituent elements of the sheet transport portion that transports the sheet in the image forming apparatus.

In the above-described configuration, a configuration is possible in which in a case where the jamming was detected at a time that is after the sheet arrived at the first reference detection position and before the sheet arrives at the second reference detection position, the forced moving processing unit forcibly moves the sheet a first moving distance obtained by subtracting a first transport distance from a first reference distance, the first transport distance being calculated using a first jamming detection time that is from a detection time at the first reference detection position to the time when the jamming was detected, and the first reference distance being from the first reference detection position to the sheet removal position, and in a case where the jamming was detected at a time that is after the sheet arrived at the second reference detection position and before the sheet arrives at the setting position, the forced moving processing unit forcibly moves the sheet a second moving distance obtained by subtracting a second transport distance from a second reference distance, the second transport distance being calculated using a second jamming detection time that is from a detection time at the second reference detection position to the time when the jamming was detected, and the second reference distance being from the second reference detection position to the sheet removal position.

According to this feature, in the configuration in which the first reference detection position and the second reference detection position are included as reference detection positions, the forced moving processing is performed only when necessary in conformity with the arrangement configuration of the constituent elements of the sheet transport portion that transports the sheet in the image forming apparatus, the first and second transport distances of the sheet can be easily obtained, the position of the sheet in the sheet transport path in the sheet transport direction when the jamming was detected can be easily detected, and moreover the sheet can be accurately caused to stop at the sheet removal position.

In the present invention, a configuration is possible in which the image forming apparatus further includes: a sheet storage portion that is disposed on the upstream side of the sheet transport path in the sheet transport direction and stores a plurality of the sheets, wherein included among the plurality of sheet transport rollers are a first transport roller (specifically, a paper feed roller) that is disposed on the upstream side of the first reference detection position in the sheet transport direction and supplies the sheets stored in the sheet storage portion one-by-one toward the first reference detection position, and a second sheet transport roller (e.g., a registration roller) that transports the sheets detected at the second reference detection position.

In this configuration, a configuration is possible in which the image forming apparatus further includes: an opposing sheet storage portion that is provided opposing the sheet storage portion on the first sheet transport roller side in a width direction that is orthogonal to an axial direction of the sheet transport rollers and a vertical direction, wherein the sheet transport path has a transport path that guides the sheets from the sheet storage portion and the opposing sheet storage portion toward one side in the vertical direction, and the sheet removal job region is provided in the vicinity of the sheet storage portion and the opposing sheet storage portion on the downstream side thereof in the sheet transport direction. In this configuration, since another constituent member (specifically, the opposing sheet storage portion) is often provided in the vicinity of the transport path, sometimes there is a limit to the space for providing the sheet removal job region in the vicinity of the transport path, and in such a case, it tends to not be likely for the downstream side edge (leading edge) of the sheet in the sheet transport direction to have arrived at the sheet removal job region when the jamming was detected.

In view of this point, in the present invention, even with a configuration in which it is not likely for the downstream side edge (leading edge) of the sheet in the sheet transport direction to have arrived at the sheet removal job region when the jamming was detected, in the case where it has been detected that the downstream side edge (leading edge) of the sheet in the sheet transport direction was not located in the sheet removal job region when jamming was detected, when the rotational driving of the sheet transport rollers by the driving portion is stopped due to detecting jamming, the sheet is transported so as to be forcibly moved to the sheet removal position, thus enabling reliably causing the sheet that was motionless when the jamming was detected to be located in the sheet removal job region.

In the present invention, in the configuration in which the sheet storage portion is further provided, and the first sheet transport roller and the second sheet transport roller are included among the plurality of sheet transport rollers, the sheet storage portion may be provided so as to be capable of being inserted into and removed from an apparatus main body of the image forming apparatus along an axial direction of the sheet transport rollers.

In this configuration, it is preferable that the forced moving processing determination unit determines that the forced moving processing is not to be performed by the forced moving processing unit in the case where the jamming was detected before the downstream side edge of the sheet in the sheet transport direction arrives at the first reference detection position or before the start of rotation of the second sheet transport roller is detected. According to this configuration, the sheet does not arrive at the second sheet transport roller even if jamming is detected, thus enabling effectively preventing damage to the sheet due to the sheet storage portion being pulled out in the axial direction of the sheet transport roller.

In the present invention, a configuration is possible in which when the second sheet transport roller is rotationally driven, the first sheet transport roller is also rotationally driven, and in a case where the size of the sheet in the sheet transport direction is smaller than a pre-set first setting size, the forced moving processing unit changes the sheet removal position according to the size of the sheet in the transport direction.

According to this feature, the sheet removal position is changed in accordance with the size of the sheet in the transport direction in the case where the size of the sheet in the sheet transport direction is smaller than the first setting size, thus enabling causing the sheet whose size is smaller than the first setting size to be located at the sheet removal position before the upstream side edge (trailing edge) of the sheet in the sheet transport direction passes the first sheet transport roller. Accordingly, if it has been detected that the downstream side edge (leading edge) of the sheet in the sheet transport direction had not arrived at the sheet removal job region when the jamming was detected, it is possible to forcibly move the sheet to the sheet removal position, and moreover it is possible to avoid an inconvenience in which the next sheet stored in the sheet storage portion is transported by the first transport roller.

Also, in the present invention, a configuration is possible in which when the second sheet transport roller is rotationally driven, the first sheet transport roller is also rotationally driven, and in a case where the size of the sheet in the sheet transport direction is smaller than a pre-set second setting size, the forced moving processing unit determines that the forced moving processing is not to be performed by the forced mobbing processing unit.

According to this feature, the forced moving processing is not performed by the forced moving processing unit in the case where the size of the sheet in the sheet transport direction is smaller than the second setting size, and therefore even in the case where it has been detected that the downstream side edge (leading edge) of the sheet in the sheet transport direction whose size is smaller than the second setting size had not arrived at the sheet removal job region when the jamming was detected, it is not possible to forcibly move the sheet to the sheet removal position, but it is possible to avoid the inconvenience in which the next sheet stored in the sheet storage portion is transported by the first transport roller.

BRIEF DESCRIPTION OF THE DRAWINGS

FIG. 10 is a table showing dimensions with respect to various sheet sizes.

DESCRIPTION OF THE INVENTION

Hereinafter, an embodiment of the present invention will be described with reference to the drawings.

Overall Configuration of Image Forming Apparatus

Figure 1:
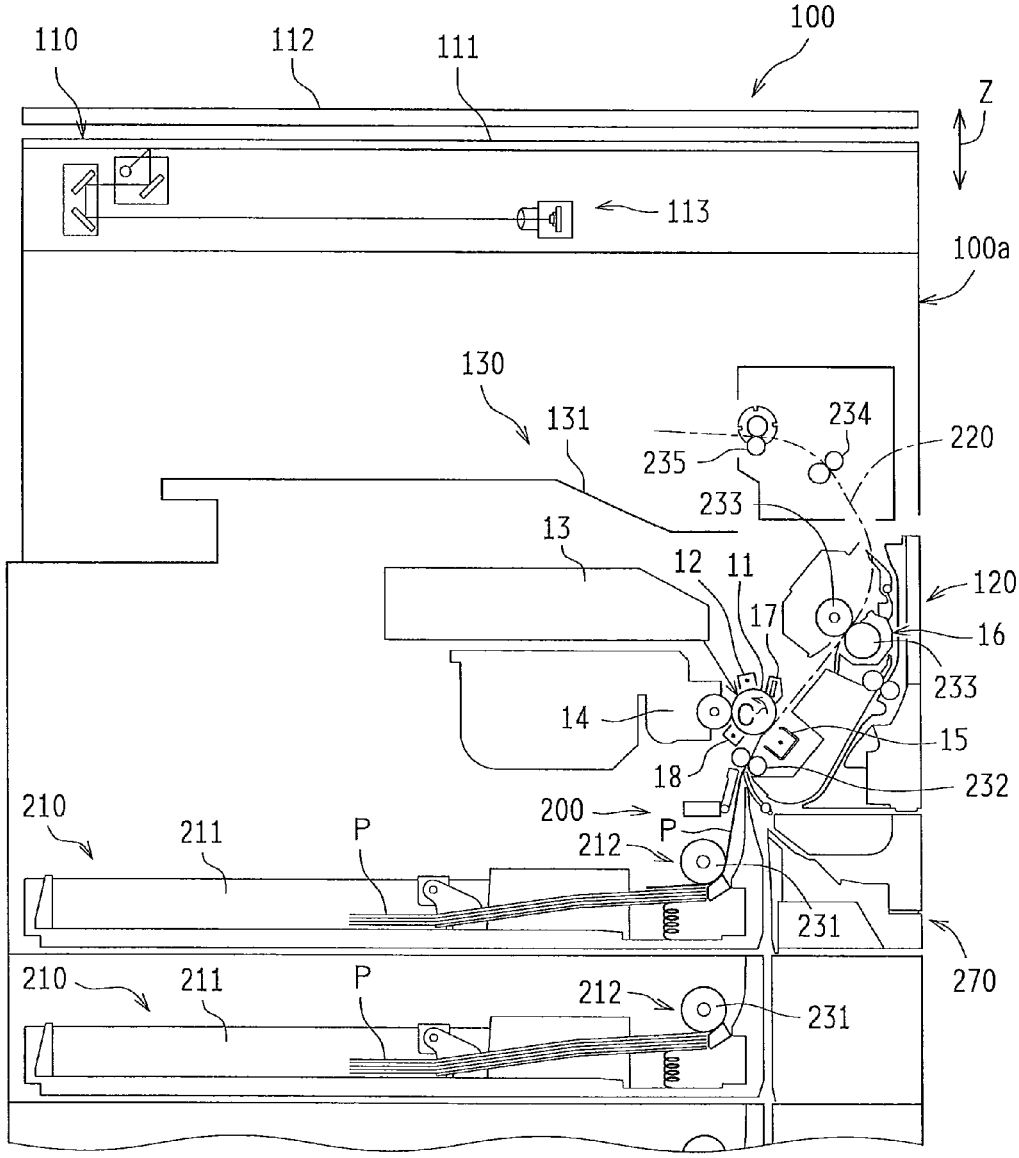
FIG. 1 is a schematic cross-sectional diagram of an image forming apparatus according to an embodiment of the present invention as viewed from the front.

FIG. 1 is a schematic cross-sectional diagram of an image forming apparatus 100 according to an embodiment of the present invention as viewed from the front.

First, the overall configuration of the image forming apparatus 100 will be described with reference to FIG. 1. In the present embodiment, the image forming apparatus 100 shown in FIG. 1 forms an image using an electrophotographic image forming process. The image forming apparatus 100 forms a monochrome (single-color) image on a sheet P based on image data that has been read from an original (not shown) or image data that has been received from an external apparatus (not shown).

The image forming apparatus 100 includes an image carrier (specifically, a photosensitive drum 11), a charging apparatus (specifically, a charger 12) for charging the surface of the photosensitive drum 11, an exposing apparatus (specifically, an exposing unit 13) for forming an electrostatic latent image on the photosensitive drum 11, a development apparatus (specifically, a developer 14) for forming a toner image on the photosensitive drum 11 by developing the electrostatic latent image on the photosensitive drum 11 using a developer, a transfer apparatus (specifically, a transfer charger 15) for transferring the toner image on the photosensitive drum 11 onto a sheet of recording paper or the like (hereinafter, referred to as the sheet P), a fixing apparatus (specifically, a fixing unit 16) by which the transfer image on the sheet P is fixed onto the sheet P, a cleaning apparatus (specifically, a cleaning unit 17) for removing the residual toner that was not transferred by the transfer charger 15 and remained on the surface of the photosensitive drum 11, a neutralization apparatus (specifically, a neutralizer 18) that neutralizes the charge on the photosensitive drum 11, and a control portion 20 (not shown in FIG. 1; see the later-described FIG. 6).

An apparatus main body 100*a* of the image forming apparatus 100 is provided with an original reading apparatus 110, a sheet transport portion 200, an image forming portion 120, and a sheet discharge portion 130.

The upper face portion of the original reading apparatus 110 is provided with an original table 111 that is made of transparent glass and is for the placement of an original, and an original cover member 112 is provided above the original table 111 so as to be capable of swinging open with the support point on the back face side such that the front face side is released.

The original reading apparatus 110 includes a scanner portion 113 that operates as an original reading portion for reading image information of an original that is placed on the original table 111 and held by the original cover member 112.

A discharge tray 131 that constitutes the sheet discharge portion 130 is disposed below the scanner portion 113, and the image forming portion 120 is disposed below the discharge tray 131.

The sheet transport portion 200 includes a paper feed portion 210, which is one example of a sheet storage portion, a sheet transport path 220, multiple sheet transport rollers (specifically, paper feed rollers 231, registration rollers 232 (registration roller pair), fixing rollers 233 (fixing roller pair), post-fixing transport rollers 234 (post-fixing transport roller pair), and discharge rollers 235 (discharge roller pair)) including first and second sheet transport rollers, and driving portions (specifically, a sheet transport driving portion 240, a fixing driving portion 250, and a sheet discharge driving portion 260 (not shown in FIG. 1; see the later-described FIG. 5)). The sheet transport portion 200 is configured such that a sheet P stored in the paper feed portion 210 is transported, due to the driving of the sheet transport driving portion 240 and the fixing driving portion 250, in the sheet transport path 220 that arrives at the discharge tray 131 of the sheet discharge portion 130 via the image forming portion 120, and then discharged to the discharge tray 131 by the discharge rollers 235 due to the driving of the sheet discharge driving portion 260. Note that details of the sheet transport portion 200 will be described later.

The image forming portion 120 is for forming an image on the sheet P based on image data, and includes the photosensitive drum 11, the charger 12, the exposing unit 13, the developer 14, the transfer charger 15, the fixing unit 16, the cleaning unit 17, and the neutralizer 18 that were mentioned above.

Here, the photosensitive drum 11 is cylindrical and configured so as to be rotated in a pre-set rotation direction (arrow C direction in the figure) by a print processing driving portion 36 (not shown in FIG. 1; see the later-described FIG. 5) when image forming is performed. The cleaning unit 17, the charger 12, the developer 14, and the neutralizer 18 are disposed along the outer circumferential face of the photosensitive drum 11 in the stated order moving downstream in the rotation direction C of the photosensitive drum 11 using a position after the end of image transfer as the reference.

Configuration of Sheet Transport Portion

Next, a description of the sheet transport portion 200 that transports the sheet P will be given with reference to FIGS. 2 to 4.

Figure 2:
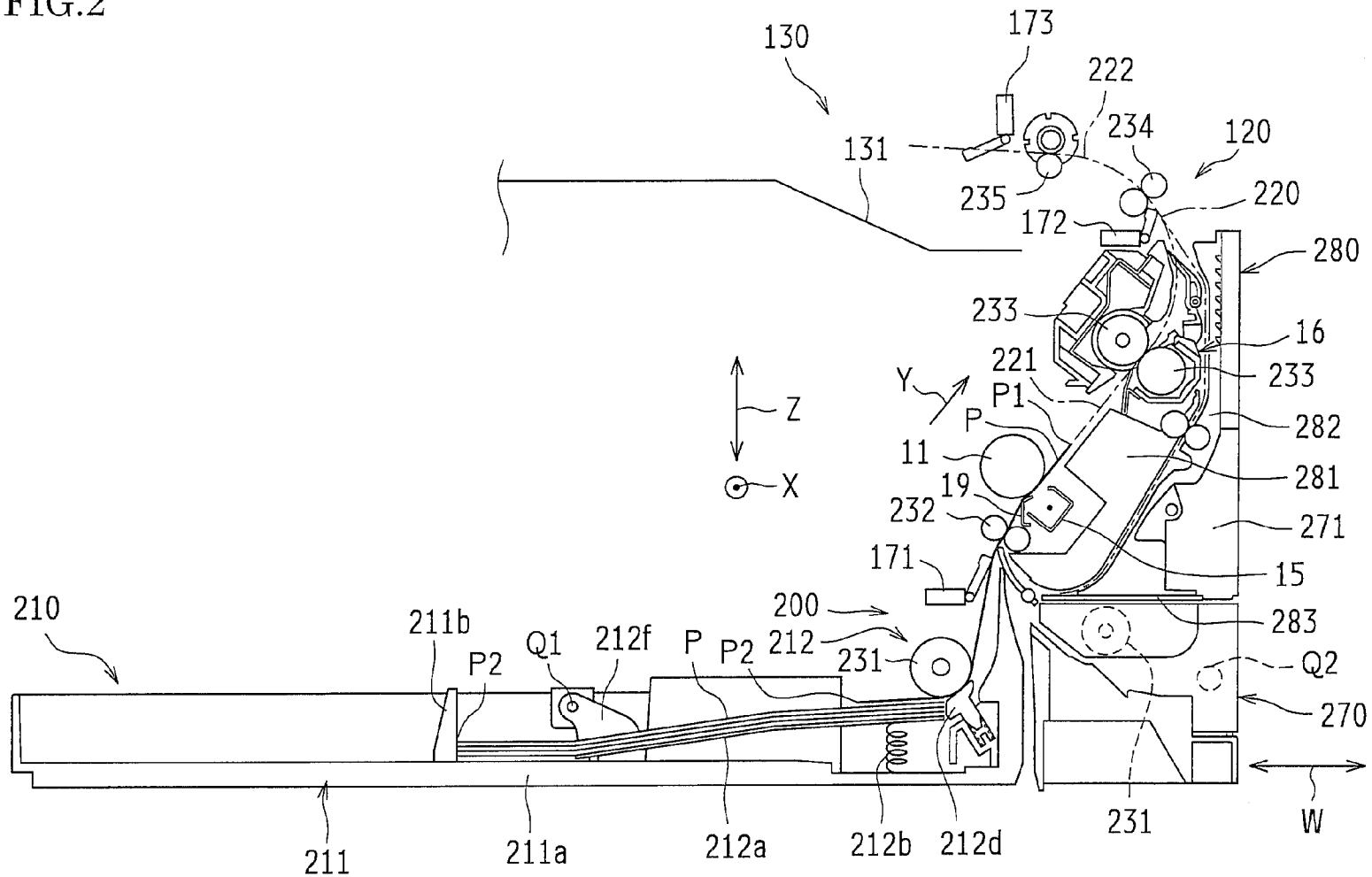
FIG. 2 is a schematic cross-sectional diagram for describing a schematic configuration of a sheet transport portion according to the embodiment of the present invention, and shows the closed state of an access cover portion that opens and closes a sheet transport path in the sheet transport portion.
Figure 3:
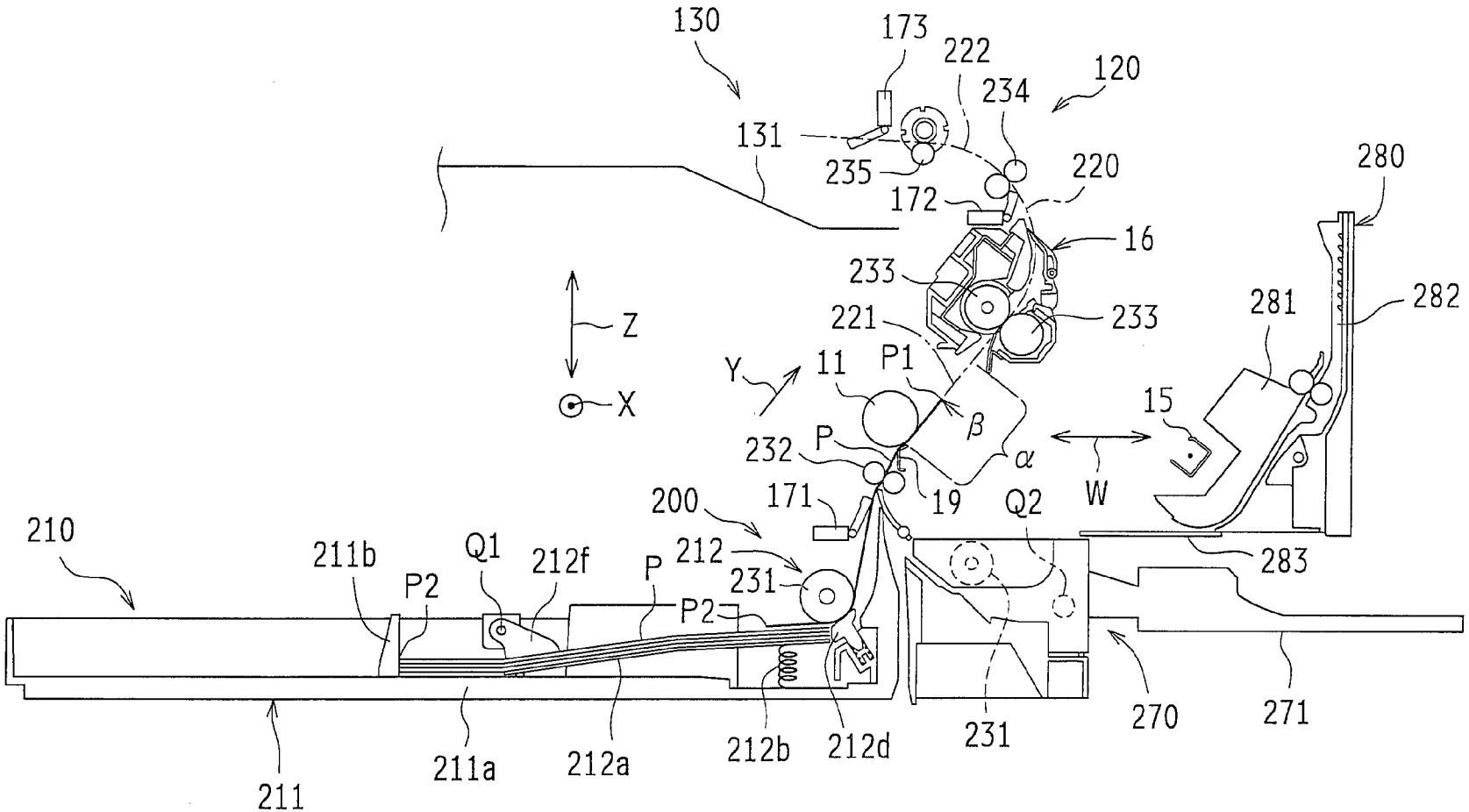
FIG. 3 is a schematic cross-sectional diagram for describing the schematic configuration of the sheet transport portion according to the embodiment of the present invention, and shows the fully-opened state of the access cover portion.

FIGS. 2 and 3 are schematic cross-sectional diagrams for describing the schematic configuration of the sheet transport portion 200 of this embodiment of the present invention. FIG. 2 shows the closed state of an access cover portion 280 that opens and closes the sheet transport path 220 in the sheet transport portion 200. FIG. 3 shows the fully-open state of the access cover portion 280. Note that in FIGS. 2 and 3, only the top-level paper feed portion 210 among the multiple paper feed portions 210 is shown, and the cleaning unit 17, the charger 12, the exposing unit 13, the developer 14, the neutralizer 18, the lower-level paper feed portions 210 and the like are not shown.

The paper feed portions 210 include paper feed trays 211 and paper feed mechanisms 212 provided in correspondence with the paper feed trays 211. The paper feed portions 210 are provided below the image forming portion 120 and have a multi-level configuration in which they are stacked along the vertical direction (Z direction in the figure). Note that although the paper feed portions 210 have a multi-level configuration in the example shown in FIG. 1, a single-level configuration is possible.

In the present embodiment, the paper feed trays 211 are each for the accumulation of multiple sheets P on which image information is to be output (printed), and have a volume capable of storing approximately 500 sheets P of typical sizes such as A4, A3, and B4.

Figure 4:
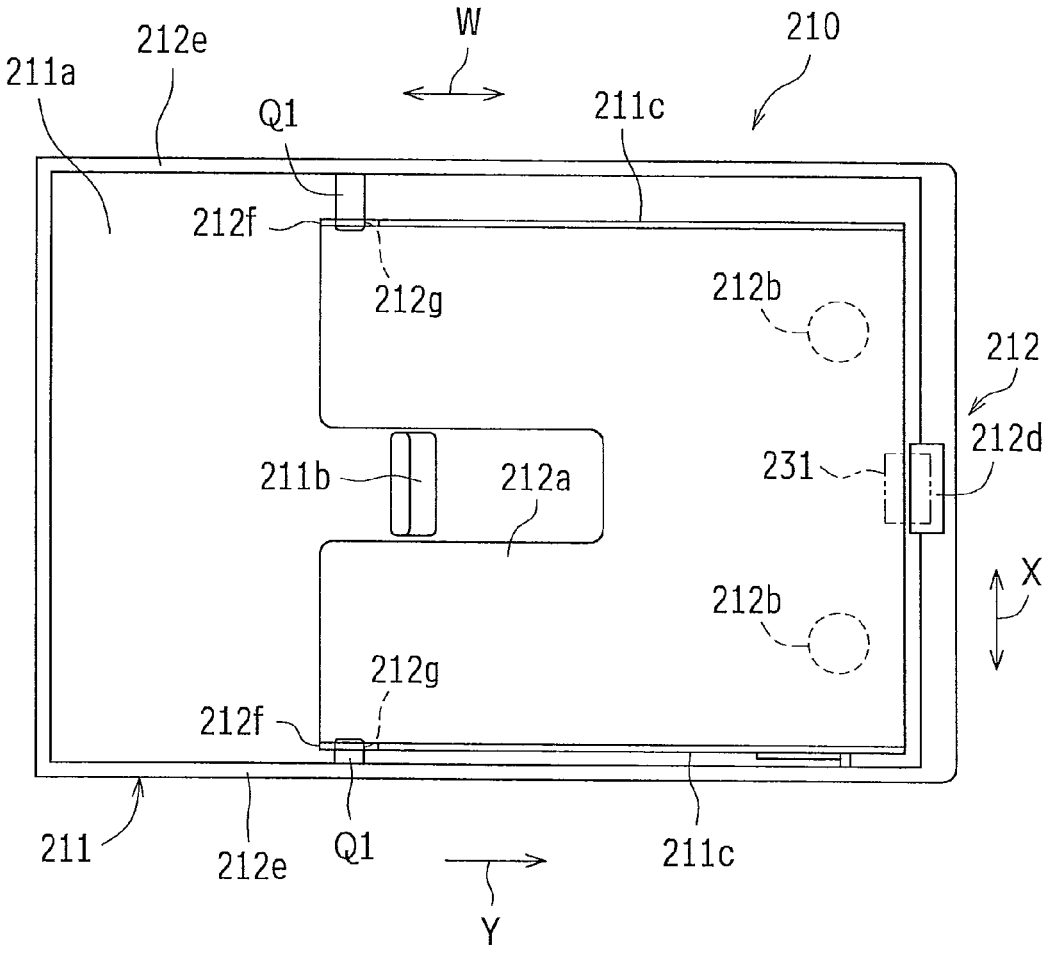
FIG. 4 is a plan view showing a schematic configuration of an example of a paper feed tray in a paper feed portion.

FIG. 4 is a plan view showing the schematic configuration of an example of the paper feed tray 211 in the paper feed portion 210. Note that FIG. 4 shows the state in which sheets P are not stored in the paper feed tray 211.

The paper feed tray 211 includes a storage container 211*a* for storing multiple sheets P, a first restricting member 211*b* for restricting rearward movement of the sheets P stored in the storage container 211*a* at the upstream side edge (trailing edge) of the sheets P in the sheet transport direction Y, and second restricting members 211*c* for restricting the position of the sheets P stored in the storage container 211*a* in the axial direction of the paper feed roller 231 (depth direction X) in the paper feed mechanism 212.

The paper feed mechanism 212 includes a loading member (specifically, a rotating plate 212*a*) on which multiple sheets P can be loaded, biasing members (specifically, coil springs 212*b*) for upward biasing of the downstream side edge (leading edge) portion of the rotating plate 212*a* in the sheet transport direction Y, the paper feed roller 231 for drawing the top sheets P that are stored in the storage container 211*a* and loaded on the rotating plate 212*a*, and a separating member 212*d* for causing the sheets P drawn by the paper feed roller 231 to be transported one-by-one.

The rotating plate 212*a* can have multiple sheets P loaded thereon, and the tip portion can move vertically. Specifically, in the end portion of the rotating plate 212*a* on the side opposite to the sheet discharge side, the rotating plate 212*a* is supported by support members 212*e* so as to be capable of pivoting about rotation shafts Q1 that conform to the depth direction X.

Specifically, the support members 212*e* are side plates on respective sides of the storage container 211*a* in the depth direction X. The support members 212*e* each support a rotation shaft Q1. In the end portion of the rotating plate 212*a* on the side opposite to the sheet discharge side, the rotating plate 212*a* has engagement support point portions 212*f* that extend upward at respective end portions in the depth direction X. Also, the engagement support point portions 212*f* are each provided with a through-hole 212*g* that penetrates in the depth direction X. The rotation shafts Q1 are inserted into the through-holes 212*g* so as to be able to rotate about the axial line. Accordingly, the rotating plate 212*a* is configured so as to be supported by the support members 212*e* via the rotation shafts Q1, so as to be capable of pivoting about the rotation shafts Q1. Note that the storage container 211*a* and the rotating plate 212*a* are both quadrangular in plan view, and the rotating plate 212*a* is stored in the storage container 211*a*.

The coil springs 212*b* are configured such that the tip portion side of the rotating plate 212*a* is biased upward about the rotation shafts Q1 disposed conforming to the depth direction X, and one or more coil springs 212*b* (two in the figure) are provided between the rotating plate 212*a* and a bottom plate 211*d* of the storage container 211*a* on the tip portion side of the rotating plate 212*a*.

The paper feed roller 231 is disposed above the sheet discharge side (leading edge P1 side of the stored sheets P) of the paper feed tray 211. The separating member 212*d* is disposed opposing the paper feed roller 231. Although the separating member 212*d* is a separating pad here, a separating roller may be used.

With the paper feed mechanism 212, the sheets P located at the top of the sheets P placed on the rotating plate 212*a*, which is in a tilted state due to the tip portion side being biased upward by the coil springs 212*b*, are drawn in order by the paper feed roller 231, and the sheets P located at the top are separated by the separating member 212*d*, and thus the sheets P are supplied one-by-one toward the sheet transport path 220.

As shown in FIGS. 2 and 3, in the present embodiment, a side face (on the right side in the figure) of the image forming apparatus 100 is provided with a manual paper feed portion 270 that has a manual paper feed tray 271.

The manual paper feed portion 270 is configured so as to operate as an opposing sheet storage portion provided opposing the paper feed roller 231 side of the top-level paper feed tray 211 in the width direction (W direction in the figure) that is orthogonal to the depth direction X and the vertical direction Z. With the manual paper feed tray 271, mainly a small number of and/or non-typical sizes of sheets P are supplied by the paper feed roller 231. In the present embodiment, the manual paper feed tray 271 is capable of swinging about a swing shaft Q2 that conforms to the depth direction X relative to the apparatus main body 100*a*. In FIG. 3, the paper feed tray 271 is shown in the open state. Note that the opposing sheet storage portion may be a large capacity paper feed cassette (LCC) that stores a large capacity of sheets P (e.g., 1000 sheets or more).

The sheet transport path 220 is configured such that sheets P are guided from the paper feed portion 210 and the manual paper feed portion 270, through the image forming portion 120, and then to the discharge tray 131 of the sheet discharge portion 130. Specifically, the sheet transport path 220 has a first transport path 221 for guiding sheets P from the top-level paper feed portion 210 and the manual paper feed portion 270 toward the image forming portion 120 in one direction (here, upward) in the vertical direction Z, and a second transport path 222 for guiding sheets P from the image forming portion 120 toward the discharge tray 131 of the sheet discharge portion 130 in one direction (leftward in the figure) in the width direction W.

Also, a sheet removal job region α (see FIG. 3) for removing a sheet P that was motionless when jamming was detected is provided in the first transport path 221 of the sheet transport path 220. Here, the sheet removal job region α is a region for removing a sheet P that was motionless when jamming was detected in the sheet transport path 220, by opening the access cover portion 280. Specifically, in the case where a sheet P has stopped in the sheet removal job region α, when the access cover portion 280 is opened, the user can find the motionless paper P and remove the motionless sheet P.

In the present embodiment, the sheet removal job region α is provided in the vicinity of the paper feed portion 210 and the manual paper feed portion 270 on the downstream side thereof in the sheet transport direction Y.

Here, the access cover portion 280 is configured so as to open and close the sheet removal job region α in the sheet transport path 220 in order to remove a sheet P. In the present embodiment, the access cover portion 280 is capable of sliding in the width direction W relative to the manual paper feed portion 270. Specifically, the access cover portion 280 includes a transport guide member 281 that constitutes part of the sheet transport path 220, an access cover 282 provided outward of the transport guide member 281, and a slide mechanism 283 that allows the transport guide member 281 to slide in the width direction W relative to the manual paper feed portion 270. Note that a conventionally-well known slide mechanism can be used as the slide mechanism 283, and therefore a detailed description thereof will not be given. Also, in the present embodiment, the slide mechanism 283 is configured so as to allow the access cover portion 280 to slide after the manual paper feed tray 271 is opened. Also, in the present embodiment, the transfer charger 15 is provided inward of the transport guide member 281.

The sheet transport rollers (specifically, the paper feed roller 231, the registration rollers 232, the fixing rollers 233, the post-fixing transport rollers 234, and the discharge rollers 235) are provided along the sheet transport path 220 in order to transport sheets P in the sheet transport direction Y in the sheet transport path 220. The paper feed roller 231 (one example of the first sheet transport roller) is provided in the paper feed portion 210 and the manual paper feed portion 270. The registration rollers 232 (one example of the second sheet transport roller) are provided in the image forming portion 120 on the downstream side of the paper feed rollers 231 in the sheet transport direction Y. The fixing rollers 233 are provided in the fixing unit 16 of the image forming portion 120 on the downstream side of the registration rollers 232 in the sheet transport direction Y. The post-fixing transport rollers 234 are provided in the image forming portion 120 on the downstream side of the fixing rollers 233 in the sheet transport direction Y. The discharge rollers 235 are provided in the sheet discharge portion 130 on the downstream side of the post-fixing transport rollers 234 in the sheet transport direction Y. Note that a guide member 19 that constitutes part of the sheet transport path 220 is provided between the registration rollers 232 and the transfer charger 15.

Configuration of Control System of Image Forming Apparatus

Figure 5:
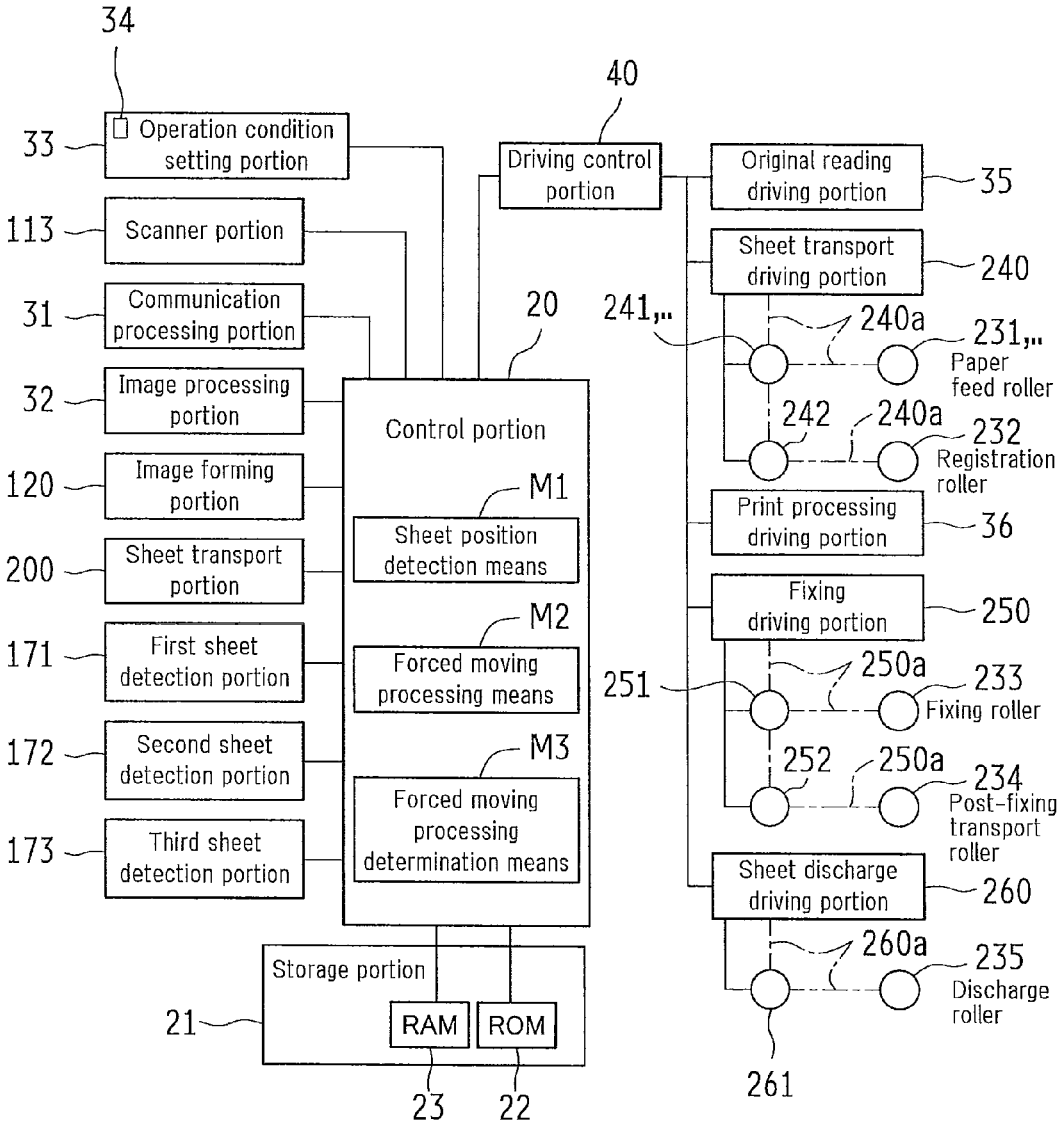
FIG. 5 is a block diagram schematically showing a control configuration of the image forming apparatus shown in FIG. 1.

Next, a description of a control system of the image forming apparatus 100 shown in FIG. 1 will be given with reference to FIG. 5. FIG. 5 is a block diagram schematically showing the control configuration of the image forming apparatus 100 shown in FIG. 1.

As shown in FIG. 5, the control portion 20 included in the image forming apparatus 100 controls the overall operation of the image forming apparatus 100. The control portion 20 is made up of, for example, a central processing unit such as a CPU, and is connected to a storage portion 21. The storage portion 21 includes semiconductor memories such as a ROM (Read Only Memory) 22 and a RAM (Random Access Memory) 23.

The ROM 22 is for storing mainly a control program that is a procedure of processing executed by the control portion 20. The RAM 23 is for providing mainly a work area for jobs.

The control portion 20 is configured so as execute image reading processing, image processing, image forming processing, sheet P transport processing, and the like with use of a temporary storage means such as the RAM 23 in accordance with a control program that has been stored in the ROM 22 in advance. Note that a storage means such as an HDD (Hard Disk Drive) can be used in place of the semiconductor memories such as the ROM 22 and the RAM 23.

The image forming apparatus 100 is configured such that image information of an original (original image data) that was read by the scanner portion 113 or image information that was transmitted from any of various terminal apparatuses connected to a communication network (not shown) is input to an image processing portion 32 via a communication processing portion 31.

In accordance with the control program, the image processing portion 32 processes image information stored in the storage portion 21 such as the RAM 23 so as to obtain printing image information that is suited for printing (image formation on a sheet P). The printing image information is input to the image forming portion 120. The image forming apparatus 100 is provided with an operation condition setting portion 33. The operation condition setting portion 33 sets operation conditions such as a transport condition for the sheet transport portion 200 in accordance with an image forming condition such as an image forming request such as the number of sheets to be printed that has been set by a user using operation switches 34.

Also, the image forming apparatus 100 is configured such that the operations of the original reading driving portion 35, the sheet transport driving portion 240, the print processing driving portion 36, the fixing driving portion 250, and the sheet discharge driving portion 260 are performed under control of the driving control portion 40 in accordance with the operation conditions that have been set.

The original reading driving portion 35 is an actuator for driving the scanner portion 113, and serves as a motor for driving the scanner portion 113.

The sheet transport driving portion 240 is an actuator for driving the sheet transport portion 200, and serves as a motor for driving the sheet transport portion 200. More specifically, the sheet transport driving portion 240 is a driving motor for rotationally driving the paper feed rollers 231 and the registration rollers 232.

Specifically, the sheet transport driving portion 240 is configured so as to rotationally drive the paper feed rollers 231 and the registration rollers 232 via a drive transmission mechanism 240*a* that includes gears, belts, and the like using a drive source that is not shown. The sheet transport driving portion 240 includes electromagnetic clutches 241 for paper feed rollers and an electromagnetic clutch 242 for registration rollers.

The electromagnetic clutches 241 for paper feed rollers are configured so as to switch between a drive transmission state in which rotational driving is transmitted to the paper feed rollers 231 via the drive transmission mechanism 240*a*, and a cut-off state in which the transmission of rotational driving to the paper feed rollers 231 via the drive transmission mechanism 240*a* is cut-off.

The electromagnetic clutch 242 for registration rollers is configured so as to switch between a drive transmission state in which rotational driving is transmitted to the registration rollers 232 via the drive transmission mechanism 240*a*, and a cut-off state in which the transmission of rotational driving to the registration rollers 232 via the drive transmission mechanism 240*a* is cut-off.

The electromagnetic clutches 241 for paper feed rollers and the electromagnetic clutch 242 for registration rollers are configured so as to be electrically connected to the output system of the control portion 20 via the driving control portion 40, and to receive an input of operation signals from the control portion 20 via the driving control portion 40.

The print processing driving portion 36 is an actuator for driving the image forming portion 120, and serves as a driving motor for rotationally driving the photosensitive drum 11.

The fixing driving portion 250 is an actuator for driving the fixing unit 16, and serves as a driving motor for rotationally driving the fixing rollers 233 of the fixing unit 16 and the post-fixing transport rollers 234.

Specifically, the fixing driving portion 250 is configured so as to rotationally drive the fixing rollers 233 and the post-fixing transport rollers 234 via a drive transmission mechanism 250*a* that includes gears, belts, and the like using a drive source that is not shown. The driving portion 250 includes an electromagnetic clutch 251 for fixing rollers and an electromagnetic clutch 252 for post-fixing transport rollers.

The electromagnetic clutch 251 for fixing rollers is configured so as to switch between a drive transmission state in which rotational driving is transmitted to the fixing rollers 233 via the drive transmission mechanism 250*a*, and a cut-off state in which the transmission of rotational driving to the fixing rollers 233 via the drive transmission mechanism 250*a* is cut-off.

The electromagnetic clutch 252 for post-fixing transport rollers is configured so as to switch between a drive transmission state in which rotational driving is transmitted to the post-fixing transport rollers 234 via the drive transmission mechanism 250*a*, and a cut-off state in which the transmission of rotational driving to the post-fixing transport rollers 234 via the drive transmission mechanism 250*a* is cut-off.

The electromagnetic clutch 251 for fixing rollers and the electromagnetic clutch 252 for post-fixing transport rollers are configured so as to be electrically connected to the output system of the control portion 20 via the driving control portion 40, and to receive an input of operation signals from the control portion 20 via the driving control portion 40.

The sheet discharge driving portion 260 is an actuator for driving the sheet transport portion 200, and serves as a motor for driving the sheet transport portion 200. More specifically, the sheet discharge driving portion 260 is a driving motor for rotationally driving the discharge rollers 235.

Specifically, the sheet discharge driving portion 260 is configured so as to rotationally drive the discharge rollers 235 via a drive transmission mechanism 260*a* that includes gears, belts, and the like using a drive source that is not shown. The sheet discharge driving portion 260 includes an electromagnetic clutch 261 for discharge rollers.

The electromagnetic clutch 261 for discharge rollers is configured so as to switch between a drive transmission state in which rotational driving is transmitted to the discharge rollers 235 via the drive transmission mechanism 260*a*, and a cut-off state in which the transmission of rotational driving to the discharge rollers 235 via the drive transmission mechanism 260*a* is cut-off.

The electromagnetic clutch 261 for discharge rollers is configured so as to be electrically connected to the output system of the control portion 20 via the driving control portion 40, and to receive an input of operation signals from the control portion 20 via the driving control portion 40.

Note that a combination of spring clutches and electromagnetic solenoids may be used instead of the various electromagnetic clutches. Also, the driving motors of the various driving portions can be appropriately configured via a drive transmission mechanism using the same motor or different motors as the drive source.

The image forming apparatus 100 includes a first sheet detection portion 171, a second sheet detection portion 172, and a third sheet detection portion 173 as sheet detection portions for detecting the transport timing of sheets P that are transported in the sheet transport path 220 by the sheet transport rollers (specifically, the paper feed rollers 231, the registration rollers 232, the fixing rollers 233, the post-fixing transport rollers 234, and the discharge rollers 235) that are rotationally driven by the driving control portion 40.

The first sheet detection portion 171 is a pre-registration sheet sensor that detects whether a sheet P has arrived at the registration rollers 232, and is disposed in the vicinity of the registration rollers 232 on the upstream side thereof in the sheet transport direction Y. The second sheet detection portion 172 is a post-fixing sheet sensor that detects whether a sheet P has passed the fixing unit 16, and is disposed in the vicinity of the fixing unit 16 on the downstream side thereof in the sheet transport direction Y. The third sheet detection portion 173 is a post-discharge sheet sensor that detects whether a sheet P has passed the discharge rollers 235, and is disposed in the vicinity of the discharge rollers 235 on the downstream side thereof in the sheet transport direction Y (not shown in FIG. 1; see FIGS. 2 and 3).

Note that in the arrangement configuration of the constituent members of the sheet transport portion 200, the first sheet detection portion 171 is disposed in the vicinity of the registration rollers 232 on the downstream side thereof in the sheet transport direction Y, the second sheet detection portion 172 is disposed in the vicinity of the fixing unit 16 on the upstream side thereof in the sheet transport direction Y, and the third sheet detection portion 173 is disposed in the vicinity of the discharge rollers 235 on the upstream side thereof in the sheet transport direction Y.

In the present embodiment, the first to third sheet detection portions 171 to 173 are actuator-type switches that turn on/off due to the swinging of an actuator that is a moving portion, and include a transmission-type photosensor that is a combination of a light emitting element (specifically, a light emitting diode) and a photoreception element (specifically, a PIN photodiode) and transmits or blocks light by the swinging of the actuator.

The first sheet detection portion 171, the second sheet detection portion 172, and the third sheet detection portion 173 are configured so as to be electrically connected to the input system of the control portion 20, and transmit a detection signal indicating whether a sheet P was detected to the control portion 20.

The control portion 20 having this configuration controls the timing of operation signals input to the electromagnetic clutches 241 for paper feed rollers, the electromagnetic clutch 242 for registration rollers, the electromagnetic clutch 251 for fixing rollers, the electromagnetic clutch 252 for post-fixing transport rollers, and the electromagnetic clutch 261 for discharge rollers that are connected to the output system of the control portion 20 via the driving control portion 40, based on the detection signals from the first to third sheet detection portions 171 to 173 that are connected to the input system of the control portion 20.

The control portion 20 is configured such that, using the sheet transport portion 200, sheets P are supplied from the paper feed portion 210 or the manual paper feed portion 270 to the image forming portion 120, the sheets P from the paper feed portion 210 or the manual paper feed portion 270 are transported one-by-one between the photosensitive drum 11 and the transfer charger 15 in the image forming portion 120, toner images that have been formed on the photosensitive drum 11 are transferred to the sheets P, and then the unfixed toner images on the sheets P are fixed by the fixing unit 16, and thereafter the sheets P with the toner images fixed thereon are discharged to the discharge tray 131 of the sheet discharge portion 130.

In this image forming operation, the control portion 20 detects the transport of sheets P in the sheet transport path 220 and performs drive control with respect to the original reading driving portion 35, the sheet transport driving portion 240, the print processing driving portion 36, the fixing driving portion 250, and the sheet discharge driving portion 260.

In the present embodiment, transport detection for detecting the transport state of a sheet P (i.e., where the sheet P is being transported) is performed using a detection time at which the turning on of the electromagnetic clutches 241 for paper feed rollers is detected, a detection time at which a sheet P is detected by the first sheet detection portion 171, a detection time at which the turning on of the electromagnetic clutch 242 for registration rollers is detected, a detection time at which the turning on of the electromagnetic clutch 251 for fixing rollers is detected, a detection time at which a sheet P is detected by the second sheet detection portion 172, a detection time at which the turning on of the electromagnetic clutch 252 for post-fixing transport rollers is detected, a detection time at which a sheet P is detected by the third sheet detection portion 173, and a detection time at which the turning on of the electromagnetic clutch 261 for discharge rollers is detected. Note that control portion 20 can find out the detection times for the turning on of the various clutches using a predetermined program procedure.

For example, the control portion 20 is configured such that sheets P stored in the paper feed portion 210 or the manual paper feed portion 270 are supplied by the paper feed roller 231, then based on a sheet P leading edge timing signal from the first sheet detection portion 171, the sheet P is stopped by temporarily stopping the rotational driving of the paper feed roller 231 after a pre-set time has elapsed since the detection of a leading edge P1 of the sheet P, such that the sheet P is in a bent state in which the leading edge P1 of the sheet P is in contact with the registration rollers 232 in the rotation-stopped state, and then after a pre-set time has elapsed (i.e., at an image forming time at which the bent sheet P whose leading edge P1 abuts the stopped registration rollers 232 becomes synchronized with the toner image formed on the photosensitive drum 11), the sheet P is transported by starting the rotational driving of the paper feed roller 231 and the registration rollers 232. According to this configuration, the leading edge P1 of the sheet P can be aligned parallel with the registration rollers 232 using the elastic force of the bent paper P. The control portion 20 is configured such that thereafter the sheet P that was transported between the photosensitive drum 11 and a transfer belt 103 in synchronization with the electrostatic latent image on the photosensitive drum 11 is transported to the fixing unit 16 by the rotational driving of the paper feed roller 231 and the registration rollers 232, and then discharged to the discharge tray 131 of the sheet discharge portion 130 by the rotational driving of the fixing rollers 233, the post-fixing transport rollers 234, and the discharge rollers 235.

Also, the control portion 20 is configured such that sheet P jamming (paper jamming) is detected if at least one of the first to third sheet detection portions 171 to 173 has not detected a sheet P in a time period in which it should be detected (if a sheet P did not pass at least one of the first to third sheet detection portions 171 to 173 in a time period in which it should being passing), or if at least one of the first to third sheet detection portions 171 to 173 has detected a sheet P in a time period in which the sheet P should not be detected (if the sheet P passed at least one of the first to third sheet detection portions 171 to 173 in a time period in which it should not be passing).

Also, the control portion 20 is configured such that in the case where sheet P jamming has been detected using the transport times detected by the first to third sheet detection portions 171 to 173, the rotational driving of the sheet transport rollers (specifically, the paper feed rollers 231, the registration rollers 232, the fixing rollers 233, the post-fixing transport rollers 234, and the discharge rollers 235) by the sheet transport driving portion 240, the fixing driving portion 250, and the sheet discharge driving portion 260 is stopped. Note that when jamming is detected, the rotational driving of the photosensitive drum 11 by the print processing driving portion 36 is also stopped.

Forced Moving Processing

The control portion 20 is configured including a sheet position detection means M1, a forced moving processing means M2, and a forced moving processing determination means M3.

The sheet position detection means M1 detects the position of a sheet P in the sheet transport path 220 in the sheet transport direction Y when jamming was detected.

In the case where jamming has been detected and the rotational driving of the sheet transport rollers (specifically, the paper feed rollers 231, the registration rollers 232, the fixing rollers 233, the post-fixing transport rollers 234, and the discharge rollers 235) by the sheet transport driving portion 240, the fixing driving portion 250, and the sheet discharge driving portion 260 is stopped, based on the position of the sheet P in the sheet transport path 220 in the sheet transport direction Y that was detected by the sheet position detection means M1, the forced moving processing means M2 performs forced moving processing for transporting the leading edge P1 of the sheet P in the sheet transport direction Y so as to forcibly move the sheet P to a sheet removal position β (see FIG. 3) at which at least part of the sheet P (here, the leading edge P1 of the sheet P) is located in the sheet removal job region α. Note that in the case where the sheet P is located at the photosensitive drum 11 when forced moving processing is performed, the photosensitive drum 11 may also be rotated by the print processing driving portion 36 in conformity with the transporting of the sheet P.

The forced moving processing determination means M3 determines whether the forced moving processing is to be performed by the forced moving processing means M2 in accordance with the position of the sheet P in the sheet transport path 220 in the sheet transport direction Y that was detected by the sheet position detection means M1.

According to the above-described image forming apparatus 100, whether the forced moving processing is to be performed by the forced moving processing means M2 is determined in accordance with the position of the sheet P in the sheet transport path 220 in the sheet transport direction Y that was detected by the sheet position detection means M1. This enables achieving a configuration in which the forced moving processing is performed in the case where it has been detected that the leading edge P1 of the sheet P had not arrived at the sheet removal job region α in the sheet transport path 220 when jamming was detected, and the forced moving processing is not performed in the case where at least part of the sheet P (here, the leading edge P1 of the sheet P) was located in the sheet removal job region α in the sheet transport path 220 when jamming was detected. This makes it possible to avoid performing needless forced moving processing. Moreover, when forced moving processing is performed, in the case where jamming has been detected and the rotational driving of the sheet transport rollers (specifically, the paper feed rollers 231, the registration rollers 232, the fixing rollers 233, the post-fixing transport rollers 234, and the discharge rollers 235) by the driving portions (specifically, the sheet transport driving portion 240, the fixing driving portion 250, and the sheet discharge driving portion 260) is stopped, based on the position of the sheet P in the sheet transport path 220 in the sheet transport direction Y that was detected by the sheet position detection means M1, the sheet P is transported in the sheet transport direction Y so as to be forcibly moved to the sheet removal position β at which at least part of the sheet P (here, the leading edge P1 of the sheet P) is located in the sheet removal job region α, and this enables reliably causing the sheet P that was motionless when jamming was detected to be located in the removal job region α in the sheet transport path 220.

In the present embodiment, the following control operations are performed in the case of performing a consecutive image forming operation for consecutively performing image formation on multiple sheets P.

Figure 6A:
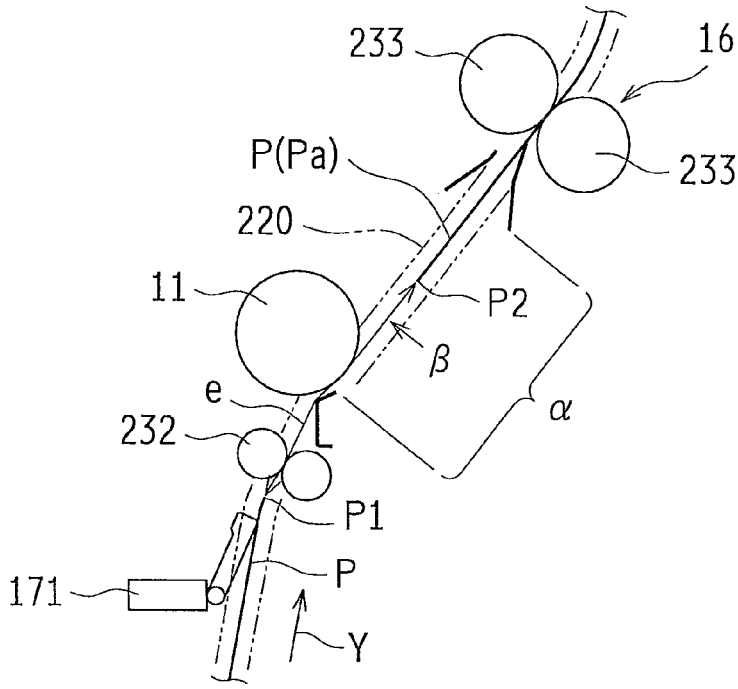
FIG. 6A is an illustrative diagram for describing the state of a sheet that is caused to stop in a sheet removal job region when jamming has been detected, in the case of performing a consecutive image forming operation for consecutively performing image formation on multiple sheets, and shows the state before forced moving processing is performed.
Figure 6B:
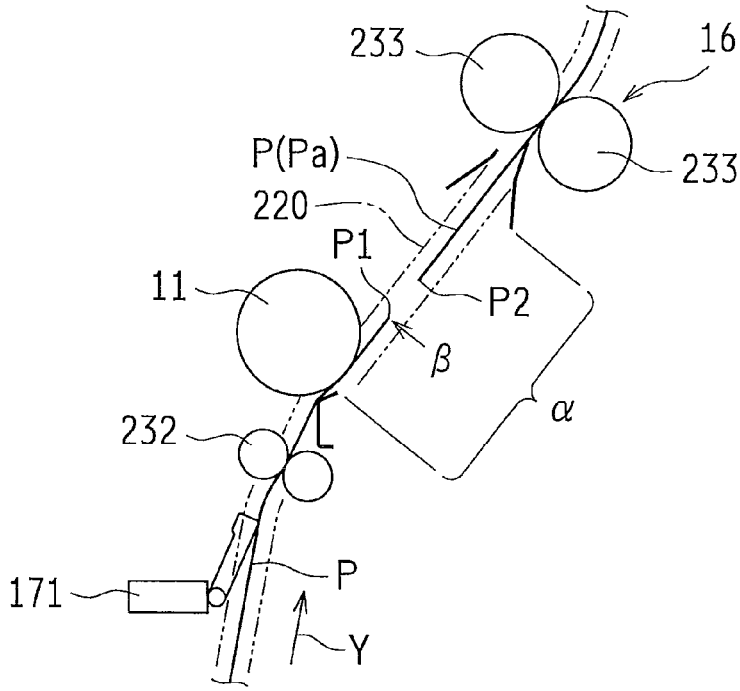
FIG. 6B is an illustrative diagram for describing the state of a sheet that is caused to stop in a sheet removal job region when jamming has been detected, in the case of performing the consecutive image forming operation for consecutively performing image formation on multiple sheets, and shows the state after forced moving processing has been performed.

FIGS. 6A and 6B are illustrative diagrams for describing the states of a sheet P that is stopped in the sheet removal job region α when jamming has been detected, in the case of performing a consecutive image forming operation for consecutively performing image formation on multiple sheets P. FIG. 6A shows the state before the forced moving processing is performed, and FIG. 6B shows the state after the forced moving processing has been performed.

In the present embodiment, in the case of performing a consecutive image forming operation for consecutively performing image formation on multiple sheets P (the distance e (e.g., 90 mm) between a sheet P(Pa) and a sheet P that are adjacent in the front-back direction) (see FIG. 6A), when the sheet P is transported in the sheet transport direction Y toward the sheet removal position β in the forced moving processing performed by the forced moving processing means M2, the sheet removal position β is a position at which the leading edge P1 of the sheet P is located on the upstream side of a trailing edge P2 of the nearest sheet P(Pa) that is motionless ahead of the sheet P (e.g., 10 mm behind the trailing edge P2 of the sheet P(Pa)) (see FIG. 6B). Here, in the present embodiment, the sheets P and P(Pa) that are adjacent in the front-back direction are, among the motionless sheets in the sheet transport path 220, sheets other than the sheet that was targeted for jamming detection.

According to this configuration, in the case of performing the consecutive image forming operation, even if the forced moving processing is performed by the forced moving processing means M2, the leading edge P1 of the sheet P does not arrive at the trailing edge P2 of the nearest sheet P(Pa) that is ahead, thus enabling avoiding a collision with the sheet P(Pa) that is nearest to the sheet P.

Figure 7:
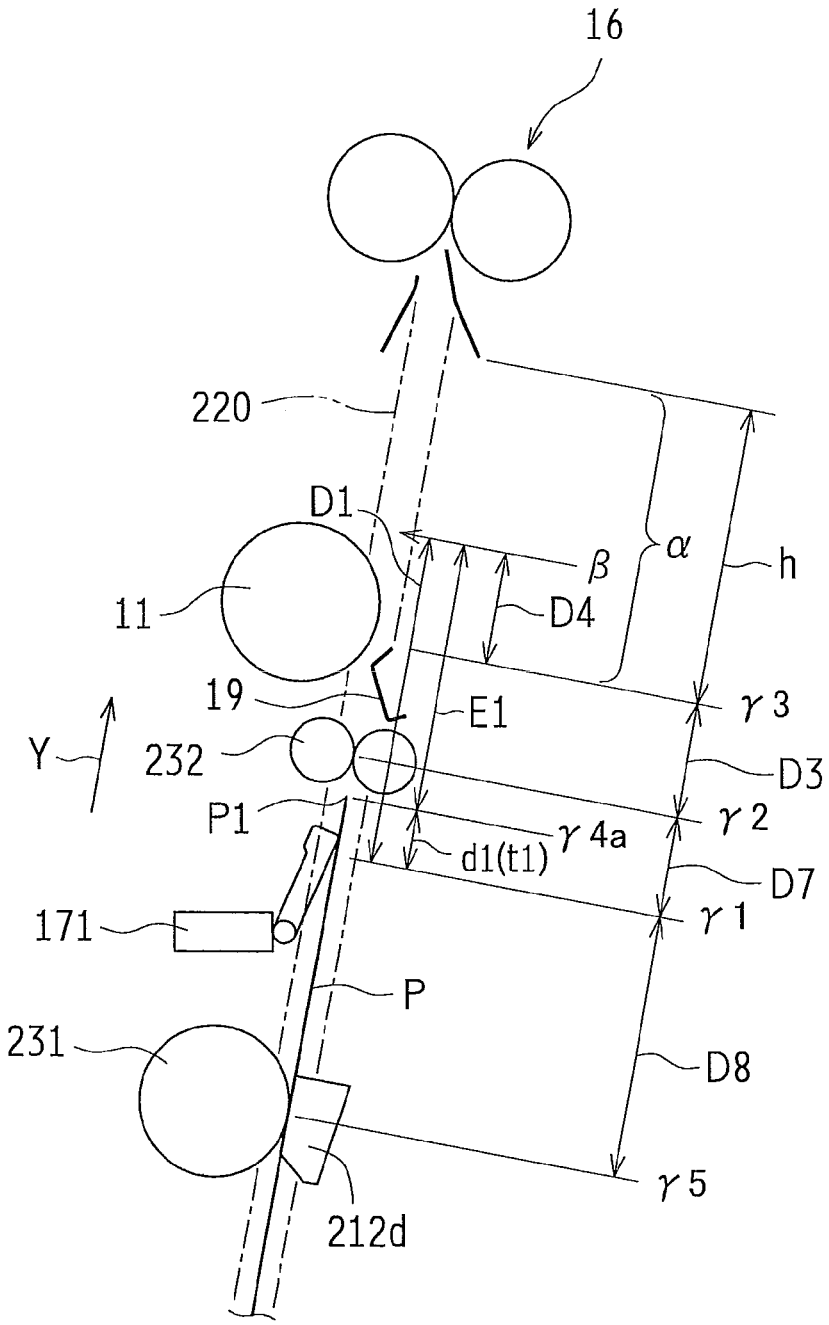
FIG. 7 is a schematic side view for describing the detection of the position of a sheet in the sheet transport path in the sheet transport direction, and shows the state of a sheet whose leading edge is between a first reference detection position and a second reference detection position when jamming has been detected.
Figure 8:
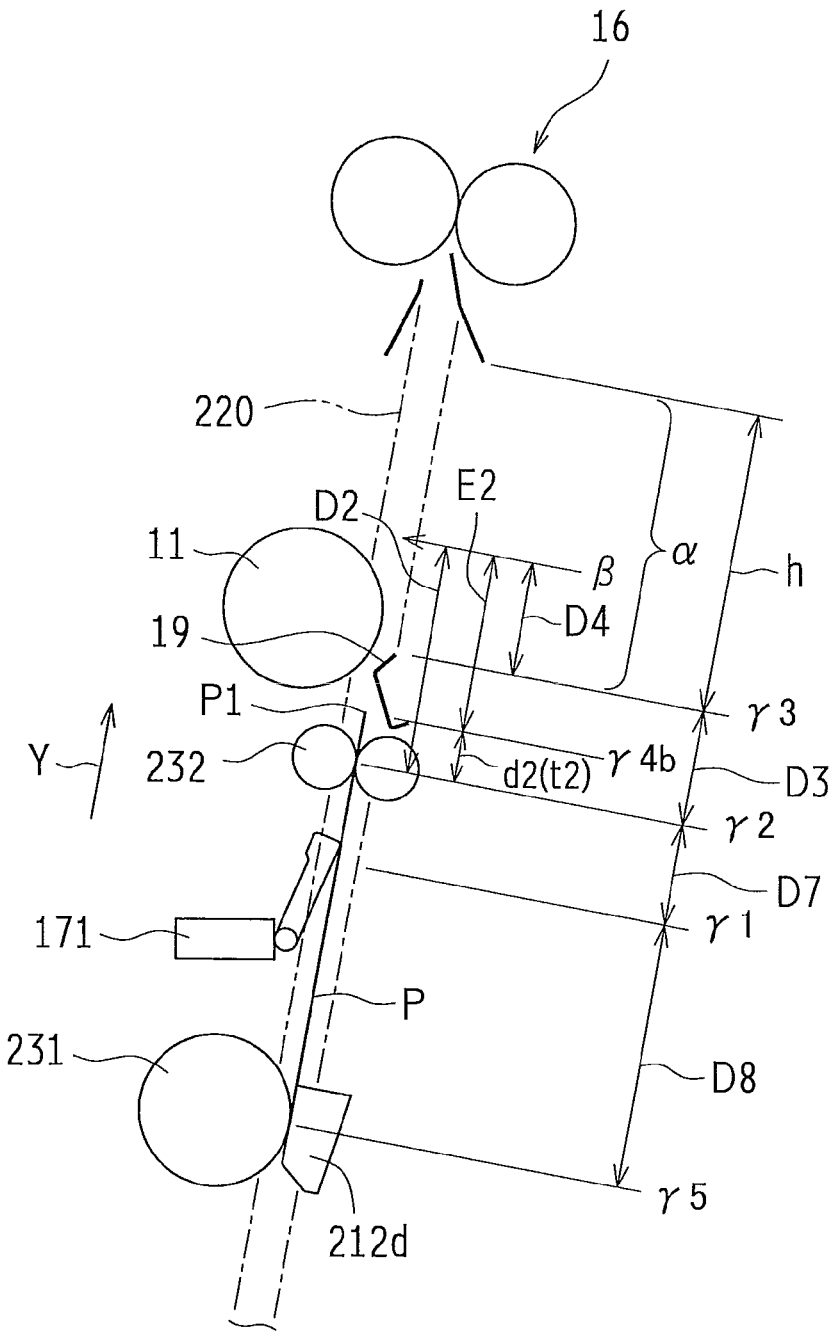
FIG. 8 is a schematic side view for describing the detection of the position of a sheet in the sheet transport path in the sheet transport direction, and shows the state of a sheet whose leading edge is between the second reference detection position and the upstream side edge of the sheet removal job region in the sheet transport direction when jamming has been detected.

FIGS. 7 and 8 are schematic side views for describing the detection of the position of a sheet P in the sheet transport path 220 in the sheet transport direction Y. FIG. 7 shows the state of the sheet P whose leading edge P1 is between a first reference detection position γ1 and a second reference detection position γ2 when jamming has been detected, and FIG. 8 shows the state of a sheet P whose leading edge P1 is between the second reference detection position γ2 and an upstream side edge γ3 of the sheet removal job region α in the sheet transport direction Y when jamming has been detected. Note that for the sake of convenience in showing distances between various members, the sheet transport path 220 is shown as a straight line in FIGS. 7 and 8.

Here, the distance between the first reference detection position γ1 and a nip position γ5 between the paper feed roller 231 and the separating member 212*d* is a distance D8 (e.g., 63 mm), the distance between the first reference detection position γ1 and the second reference detection position γ2 is a distance D7 (e.g., 16 mm), the distance between the second reference detection position γ2 and the upstream side edge γ3 of the sheet removal job region α in the sheet transport direction Y is a distance D3 (e.g., 31 mm), and the length of the sheet removal job region α in the sheet transport direction Y is a length h (e.g., 200 mm). Also, the positional relationship between the positions γ5, γ1, γ2, and γ3 and the region α in the sheet transport direction Y is stored in correspondence with the distances D8, D7, and D3 and the length h in the storage portion 21 (specifically, the ROM 22). Accordingly, the control portion 20 can be aware of the positions γ5, γ1, γ2, and γ3, and the position of the region α, as well as the distances D8, D7, and D3 and the length h that correspond thereto, using the correspondence relationship stored in the storage portion 21.

In the present embodiment, the sheet position detection means M1 is configured so as to detect the position of the sheet P in the sheet transport path 220 in the sheet transport direction Y based on a sheet P transport distance (specifically, a first transport distance d1 or a second transport distance d2) that was calculated using a jamming detection time (specifically, a first jamming detection time t1 or a second jamming detection time t2) that is from the detection time at a reference detection position (specifically, the first reference detection position γ1 or the second reference detection position γ2) to the time when jamming was detected, the reference detection position serving as a reference for the detection position of the transported sheet P on the upstream side of the sheet removal job region α in the sheet transport path 220.

In the case where the sheet P transport speed (process speed) is constant at V (e.g., 100 mm/sec), as shown in FIG. 7, if jamming is detected after the first jamming detection time t1 (e.g., 0.1 sec) from when the leading edge P1 of the sheet P is detected by the first sheet detection portion 171 until when the leading edge P1, arrives at the second reference detection position γ2 at the nip position of the registration rollers 232 (the position at the time when the turning on of the electromagnetic clutch 242 for registration rollers is detected), the sheet P is located at a first jamming detection position γ4*a* at which the leading edge P1 has advanced the first transport distance d1 (=V×t1, which is 100 mm/sec×0.1 sec=10 mm, for example) from the first reference detection position γ1, which is the detection position of the first sheet detection portion 171.

Also, as shown in FIG. 8, if jamming is detected after the second jamming detection time t2 (e.g., 0.2 sec) from when the turning on of the electromagnetic clutch 242 for registration rollers is detected (from when the rotation of the registration rollers 232 starts) until when the leading edge P1 arrives at the upstream side edge γ3 of the sheet removal job region α (having a length h in the sheet transport direction Y of 200 mm, for example) in the sheet transport direction Y, the sheet P is located at a second jamming detection position γ4*b* at which the leading edge P1 has advanced the second transport distance d2 (=V×t2, which is 100 mm/sec×0.2 sec=20 mm, for example) from the second reference detection position γ2 at the nip portion of the registration rollers 232.

With this configuration, the first and second transport distances d1 and d2 of the sheet P can be easily obtained by calculation using the first and second jamming detection times t1 and t2, which are from when the sheet P is detected at the first and second reference detection positions γ1 and γ2 until when jamming is detected, and the constant transport speed V of the sheet P. Also, the first and second jamming detection positions γ4*a* and γ4*b* of the sheet P in the sheet transport path 220 in the sheet transport direction Y when jamming was detected can be easily detected by calculation using the first and second reference detection positions γ1 and γ2 and the first and second transport distances d1 and d2. Details of this position detection will be described later with reference to FIGS. 10 and 11.

In the present embodiment, the forced moving processing means M2 is configured so as to, if the leading edge P1 of the sheet P is between the first reference detection position γ1 and the second reference detection position γ2 when jamming has been detected (see FIG. 7), the sheet P is forcibly moved a first moving distance E1 obtained by subtracting the first transport distance d1 from a first reference distance D1 that is from the first reference detection position γ1 to the sheet removal position β. Also, the forced moving processing means M2 is configured so as to, if the leading edge P1 of the sheet P is between the second reference detection position γ2 and the upstream side edge γ3 of the sheet removal job region α in the sheet transport direction Y when jamming has been detected (see FIG. 8), the sheet P is forcibly moved a second moving distance E2 obtained by subtracting the second transport distance d2 from a second reference distance D2 that is from the second reference detection position γ2 to the sheet removal position β.

Specifically, as shown in FIG. 7, assuming that the first reference distance D1 from the first reference detection position γ1, which is the detection position of the first sheet detection portion 171, to the sheet removal position β is 127 mm for example, the first moving distance E1 of the sheet P whose leading edge P1 is located between the first reference detection position γ1 and the second reference detection position γ2 is a distance (e.g., 117 mm) obtained by subtracting the first transport distance d1 (e.g., 10 mm) from the first reference distance D1 (e.g., 127 mm). Also, as shown in FIG. 8, assuming that the second reference distance D2 from the second reference detection position γ2, which is the nip position of the registration rollers 232, to the sheet removal position β is 111 mm for example, the second moving distance E2 of the sheet P whose leading edge P1 is located between the second reference detection position γ2 and the upstream side edge γ3 of the sheet removal job region α in the sheet transport direction Y is a distance (e.g., 91 mm) obtained by subtracting the second transport distance d2 (e.g., 20 mm) from the second reference distance D2 (e.g., 111 mm). Note that it is assumed that a first distance D3 from the second reference detection position γ2 to the upstream side edge γ3 of the sheet removal job region α in the sheet transport direction Y is 31 mm for example, and a second distance D4 from the upstream side edge γ3 of the sheet removal job region α in the sheet transport direction Y to the sheet removal position β is 80 mm for example.

With this configuration, in the case where the forced moving processing is performed by the forced moving processing means M2, the sheet P can be accurately caused to stop at the sheet removal position β by forcibly moving the sheet P the first or second moving distances E1 and E2 obtained by subtracting the first and second transport distances d1 and d2 from the first and second reference distances D1 and D2 that are from the first and second reference detection positions γ1 and γ2 to the sheet removal position β.

In the present embodiment, in the case where jamming is detected before the leading edge P1 of the sheet P has arrived at the first reference detection position γ1 for example, even though the leading edge P1 of the sheet P has not arrived at the sheet removal job region α, it is often the case that the sheet P can be easily removed from the paper feed portion 210 or the manual paper feed portion 270 without forced moving processing being performed by the forced moving processing means M2. Also, in the case where jamming is detected before the leading edge P1 of the sheet P has arrived at a pre-set setting position between the first reference detection position γ1 and the upstream side edge γ3 of the sheet removal job region α in the sheet transport direction Y, it is difficult to remove the sheet P from the paper feed portion 210 or the manual paper feed portion 270, and furthermore, since the leading edge P1 of the sheet P has not arrived at the sheet removal job region α, the sheet P normally cannot be found in the sheet removal job region α unless forced moving processing is performed by the forced moving processing means M2. Also, in the case where jamming is detected at a time that is after the leading edge P1 of the paper P has arrived at the upstream side edge γ3 of the sheet removal job region α in the sheet transport direction Y and before the trailing edge P2 of the sheet P has passed through the sheet removal job region α, the sheet P can normally be found in the sheet removal job region α without the forced moving processing being performed by the forced moving processing means M2.

In view of this, in the present embodiment, the forced moving processing determination means M3 is configured such that the forced moving processing is not performed by the forced moving processing means M2 if jamming is detected before the leading edge P1 of the sheet P has arrived at the first reference detection position γ1, the sheet P is transported in the sheet transport direction Y toward the sheet removal position β in the forced moving processing performed by the forced moving processing means M2 if jamming is detected before the leading edge P1 of the sheet P has arrived at a pre-set setting position that is between the first reference detection position γ1 and the upstream side edge γ3 of the sheet removal job region α in the sheet transport direction Y, and the forced moving processing is not performed by the forced moving processing means M2 if jamming is detected at a time that is after the leading edge P1 of the paper P has arrived at the upstream side edge γ3 of the sheet removal job region α in the sheet transport direction Y and before the trailing edge P2 of the sheet P has passed through the sheet removal job region α.

With this configuration, forced moving processing is performed only when necessary in conformity with the arrangement configuration of the constituent elements of the sheet transport portion 200 that transports sheets P in the image forming apparatus 100.

Figure 9A:
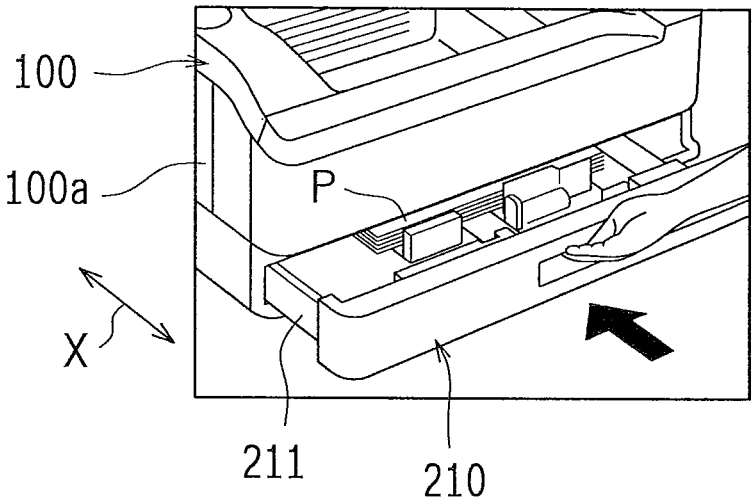
FIG. 9A is a perspective diagram for describing an inconvenience in the case where jamming occurs and the paper feed tray of the paper feed portion is pulled out along the depth direction with respect to an apparatus main body of the image forming apparatus, and shows the state in which the paper feed tray is being pulled out along the depth direction with respect to the apparatus main body.
Figure 9B:
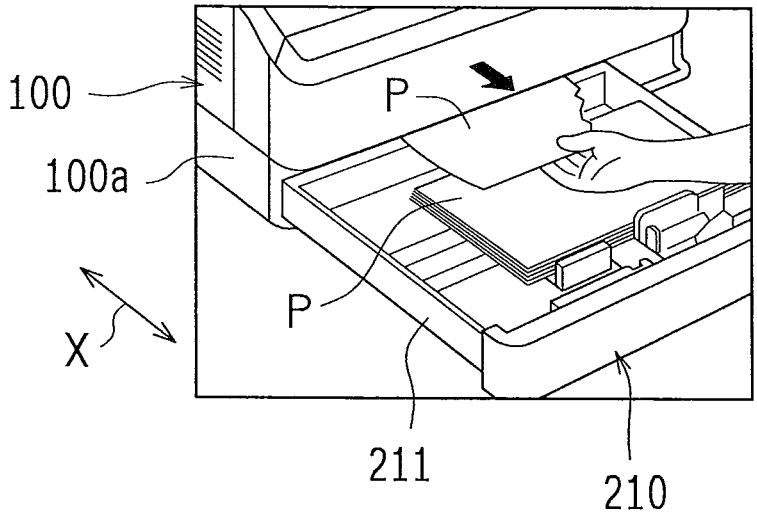
FIG. 9B is a perspective diagram for describing an inconvenience in the case where jamming occurs and the paper feed tray of the paper feed portion is pulled out along the depth direction with respect to the apparatus main body of the image forming apparatus, and shows the state in which a sheet is being removed from the paper feed tray of the paper feed portion.

FIGS. 9A and 9B are diagrams for describing an inconvenience in the case where jamming occurs and the paper feed tray 211 of the paper feed portion 210 is pulled out along the depth direction X with respect to the apparatus main body 100*a* of the image forming apparatus 100. FIG. 9A is a perspective diagram showing the state in which the paper feed tray 211 is being pulled out along the depth direction X with respect to the apparatus main body 100*a*. FIG. 9B is a perspective diagram showing the state in which a sheet P is being removed from the paper feed tray 211 of the paper feed portion 210.

In the present embodiment, the paper feed portion 210 is provided so as to be capable of being inserted into and removed from the apparatus main body 100*a* of the image forming apparatus 100 along the depth direction X. Specifically, the paper feed tray 211 of the paper feed portion 210 is detachably mounted so as to slide along the depth direction X with respect to the apparatus main body 100*a* of the image forming apparatus 100.

In a configuration in which the paper feed tray 211 of the paper feed portion 210 is provided so as to be capable of being inserted into and removed from the apparatus main body 100*a* of the image forming apparatus 100 along the depth direction X, such as in the present embodiment, in the case where jamming is detected and transporting is stopped when a sheet P is being transported by the registration rollers 232 while part of the sheet P remains in the paper feed tray 211, pulling out the paper feed tray 211 in the depth direction X and forcibly removing the sheet P (see FIG. 9A) leads to damage of the sheet P by being torn between the paper feed tray 211 and the registration rollers 232 provided in the apparatus main body 100*a* (see FIG. 9B). Furthermore, there are cases where a piece of the damaged sheet P remains in the apparatus main body 100*a* and cannot be retrieved from the apparatus main body 100*a*. In such a case, that piece may cause jamming when the next sheet is transported.

In view of this point, in the present embodiment, the forced moving processing determination means M3 may prevent the forced moving processing from being performed by the forced moving processing means M2 if jamming is detected before the leading edge P1 of the sheet P has arrived at the first reference detection position γ1 or before the start of rotation of the registration rollers 232 has been detected. As a result, the sheet P does not arrive at the registration rollers 232 even if jamming is detected, thus enabling effectively preventing the sheet P from becoming damaged due to the paper feed tray 211 being pulled out in the depth direction X.

In the configuration of the present embodiment, from the viewpoint of reliably transporting a sheet P on which the forced moving processing is performed, the paper feed roller 231 is also rotationally driven when the registration rollers 232 are rotationally driven. With this configuration, if the size of the sheet P in the sheet transport direction Y is too small, there are cases where the trailing edge P2 of the sheet P passes the paper feed roller 231 before the sheet P moves to the sheet removal position β in the forced moving processing performed by the forced moving processing means M2. This leads to an inconvenience in which the next sheet P stored in the paper feed portion 210 is transported by the paper feed roller 231.

In view of this, in the configuration of the present embodiment, the paper feed roller 231 is also rotationally driven when the registration rollers 232 are rotationally driven, and the forced moving processing means M2 is configured so as to set the sheet removal position β to a constant position (i.e., keep the second distance D4 constant) regardless of the size of the sheet P in the sheet transport direction Y if the size of the sheet P in the sheet transport direction Y is greater than or equal to a pre-set first setting size (e.g., A4 landscape size), and to change the sheet removal position according to the size of the sheet P in the sheet transport direction Y if the size of the sheet P in the sheet transport direction Y is less than the first setting size (e.g., A4 landscape size) (i.e., a third distance D5, which is from the trailing edge P2 of the sheet P being transported by the paper feed roller 231 to the nip position γ5 between the paper feed roller 231 and the separating member 212*d*).

Also, in the present embodiment, the forced moving processing determination means M3 is configured such that the forced moving processing is performed by the forced moving processing means M2 if the size of the sheet P in the sheet transport direction Y is greater than or equal to a pre-set second setting size (e.g., A5 landscape size), and the forced moving processing is not performed by the forced moving processing means M2 if the size of the sheet P in the sheet transport direction Y is less than the second setting size (e.g., A5 landscape size). Note that the second setting size is smaller than the first setting size.

FIG. 10 is a table showing dimensions with respect to various sheet P sizes. Note that in the sizes enclosed in boxes in FIG. 10 indicate lengths in the sheet transport direction Y.

Figure 11:
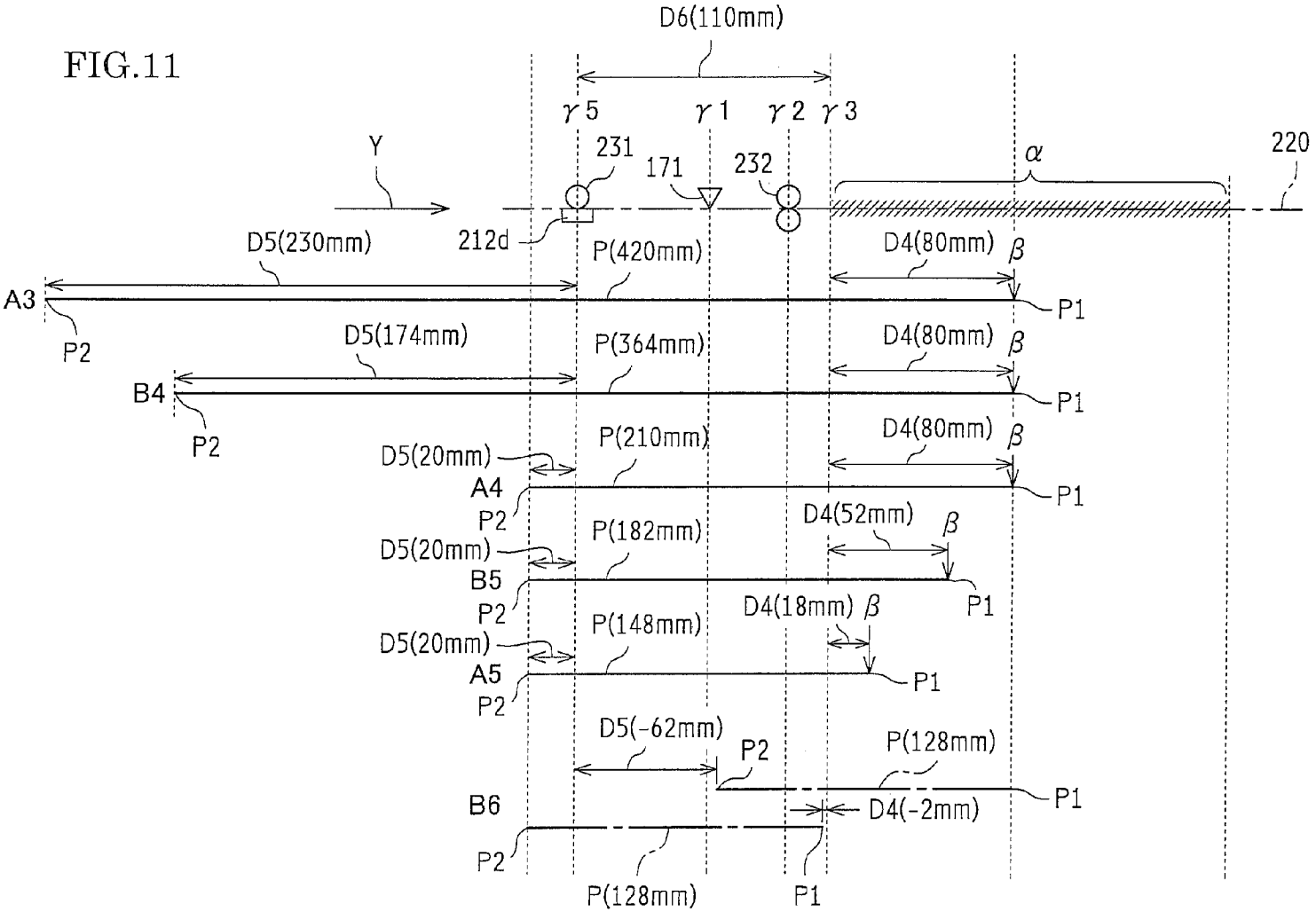
FIG. 11 is an illustrative diagram for describing a configuration in which a sheet removal position is set to a constant position if the sheet size is greater than or equal to a first setting size, the sheet removal position is changed according to the sheet size if the sheet size is smaller than the first setting size, and the forced moving processing is not performed if the sheet size is smaller than a second setting size, and shows the state of various sizes of sheets that are located at the sheet removal position after the forced moving processing has been performed.

Also, FIG. 11 is an illustrative diagram for describing the configuration in which the sheet removal position β is set to a constant position if the size of the sheet P is greater than or equal to the first setting size, the sheet removal position β is changed according to the size of the sheet P if it is less than the first setting size, and the forced moving processing is not performed if the size of the sheet P is less than the second setting size, and FIG. 11 shows the state in which various sizes of sheets P are located at the sheet removal position β after forced moving processing has been performed. Note that in FIG. 11, a fourth distance D6 from the nip position γ5 between the paper feed roller 231 and the separating member 212*d* to the upstream side edge γ3 of the sheet removal job region α in the sheet transport direction Y is 110 mm. Also, the following description takes the example of the case where the sheet P is transported in portrait orientation if larger than the A4 size, and the sheet P is transported in the landscape orientation if it is the A4 size or smaller.

As shown in FIG. 11, if the size of the sheet P in the sheet transport direction Y is greater than or equal to the pre-set first setting size (A4 landscape size), the second distance D4 is kept constant at 80 mm regardless of the size of the sheet P in the sheet transport direction Y. Also, if the size of the sheet P in the sheet transport direction Y is less than the first setting size (A4 landscape size), the third distance D5 from the nip position γ5 between the paper feed roller 231 and the separating member 212*d* to the trailing edge P2 of the sheet P is kept constant at 20 mm in consideration of sheet P detection error (e.g., transport error of the paper feed roller 231 and the registration rollers 232).

Specifically, an A3 size sheet P is greater than or equal to the first setting size (A4 landscape size), and since the trailing edge P2 of the sheet P will not pass the paper feed roller 231 even if the second distance D4 is kept constant at 80 mm, the distance 230 mm obtained by subtracting the sum distance of the constant second distance D4 (80 mm) and the fourth distance D6 (110 mm) (80 mm+110 mm=190 mm) from the vertical size 420 mm (the A3 value enclosed in a box in FIG. 10) is set as the third distance D5 from the nip position γ5 between the paper feed roller 231 and the separating member 212*d* to the trailing edge P2 of the sheet P (see "A3" in FIG. 11).

A B4 size sheet P is greater than or equal to the first setting size (A4 landscape size), and since the trailing edge P2 of the sheet P will not pass the paper feed roller 231 even if the second distance D4 is kept constant at 80 mm, the distance 174 mm obtained by subtracting the sum distance of the constant second distance D4 (80 mm) and the fourth distance D6 (110 mm) (80 mm+110 mm=190 mm) from the vertical size 364 mm (the B4 value enclosed in a box in FIG. 10) is set as the third distance D5 from the nip position γ5 between the paper feed roller 231 and the separating member 212*d* to the trailing edge P2 of the sheet P (see "B4" in FIG. 11).

An A4 size sheet P is greater than or equal to the first setting size (A4 landscape size), and since the trailing edge P2 of the sheet P will not pass the paper feed roller 231 even if the second distance D4 is kept constant at 80 mm, the distance 20 mm obtained by subtracting the sum distance of the constant second distance D4 (80 mm) and the fourth distance D6 (110 mm) (80 mm+110 mm=190 mm) from the horizontal size 210 mm (the A4 value enclosed in a box in FIG. 10) is set as the third distance D5 from the nip position γ5 between the paper feed roller 231 and the separating member 212*d* to the trailing edge P2 of the sheet P (see "A4" in FIG. 11).

A B5 size sheet P is smaller than the first setting size (A4 landscape size), and the trailing edge P2 of the sheet P will pass the paper feed roller 231 if the second distance D4 is kept constant at 80 mm, thus leading to an inconvenience in which the next sheet P stored in the paper feed portion 210 is transported by the paper feed roller 231, and therefore the distance 52 mm obtained by subtracting the sum distance of the constant third distance D5 (20 mm) and the fourth distance D6 (110 mm) (20 mm+110 mm=130 mm) from the horizontal size 182 mm (the B5 value enclosed in a box in FIG. 10) is set as the second distance D4 from the upstream side edge γ3 of the sheet removal job region α in the sheet transport direction Y to the sheet removal position β (see "B5" in FIG. 11).

An A5 size sheet P is smaller than the first setting size (A4 landscape size), and since the trailing edge P2 of the sheet P will pass the paper feed roller 231 if the second distance D4 is kept constant at 80 mm, the distance 18 mm obtained by subtracting the sum distance of the constant third distance D5 (20 mm) and the fourth distance D6 (110 mm) (20 mm+110 mm=130 mm) from the horizontal size 148 mm (the A5 value enclosed in a box in FIG. 10) is set as the second distance D4 from the upstream side edge γ3 of the sheet removal job region α in the sheet transport direction Y to the sheet removal position β (see "A5" in FIG. 11).

In contrast, since a B6 size sheet P is smaller than the second setting size (A5 landscape size), the third distance D5 obtained by subtracting the sum distance of the constant second distance D4 (80 mm) and the fourth distance D6 (110 mm) (80 mm+110 mm=190 mm) from the horizontal size 128 mm (the B6 value enclosed in a box in FIG. 10) is the negative value −62 mm, and the trailing edge P2 of the sheet P will pass the nip position γ5 between the paper feed roller 231 and the separating member 212*d* (see the upper side for "B6" in FIG. 11). Moreover, the second distance D4 obtained by subtracting the sum distance of the constant third distance D5 (20 mm) and the fourth distance D6 (110 mm) (20 mm+110 mm=130 mm) from the horizontal size 128 mm is the negative value −2 mm, and the leading edge P1 of the sheet P does not arrive at the sheet removal job region α, and therefore the sheet P is not visible in the sheet removal job region α (see the lower side for "B6" in FIG. 11). Accordingly, in the present embodiment, the forced moving processing is not performed if the size of the sheet P is smaller than the second setting size (e.g., A5 landscape size).

In this way, the sheet P can be positioned where it can be easily removed in the sheet removal job region α by keeping the sheet removal position β at a constant position if the size of the sheet P is greater than or equal to the first setting size (e.g., A4 landscape size). Also, by changing the sheet removal position β according to the size of the sheet P in the sheet transport direction Y if the size of the sheet P in the sheet transport direction Y is smaller than the first setting size (e.g., A4 landscape size), the sheet P can be positioned at the sheet removal position β before the trailing edge P2 of the sheet P whose size is smaller than the first setting size (e.g., A4 landscape size) passes the paper feed roller 231. This enables forcibly moving the sheet P to the sheet removal position β if it has been detected that the leading edge P1 of the sheet P has not arrived at the sheet removal job region α when jamming is detected, and furthermore enables avoiding an inconvenience in which the next sheet P stored in the paper feed portion 210 is transported by the paper feed roller 231.

Also, since the forced moving processing is not performed by the forced moving processing means M2 if the size of the sheet P in the sheet transport direction Y is smaller than the second setting size (e.g., A5 landscape size) that is smaller than the first setting size (A4 landscape size), even in the case where it has been detected that the leading edge P1 of a sheet P whose size is smaller than the second setting size (e.g., A5 landscape size) has not arrived at the sheet removal job region α when jamming is detected, it is not possible to forcibly move the sheet P to the sheet removal position β, but it is possible to avoid the inconvenience in which the next sheet P stored in the paper feed portion 210 is transported by the paper feed roller 231.

Although a description has been given using the centimeter specifications of sheets P with A series sizes and B series sizes, the same operations can also be performed for sheets P with inch specifications (e.g., invoice size (5.5 inches×8.5 inches) and letter size (8.5 inches×11 inches)).

Processing Operations of Control Portion 20

Next, a description of the flow of processing performed by the control portion 20 when jamming occurs in the image forming apparatus 100 will be given with reference to FIG. 12.

Figure 12:
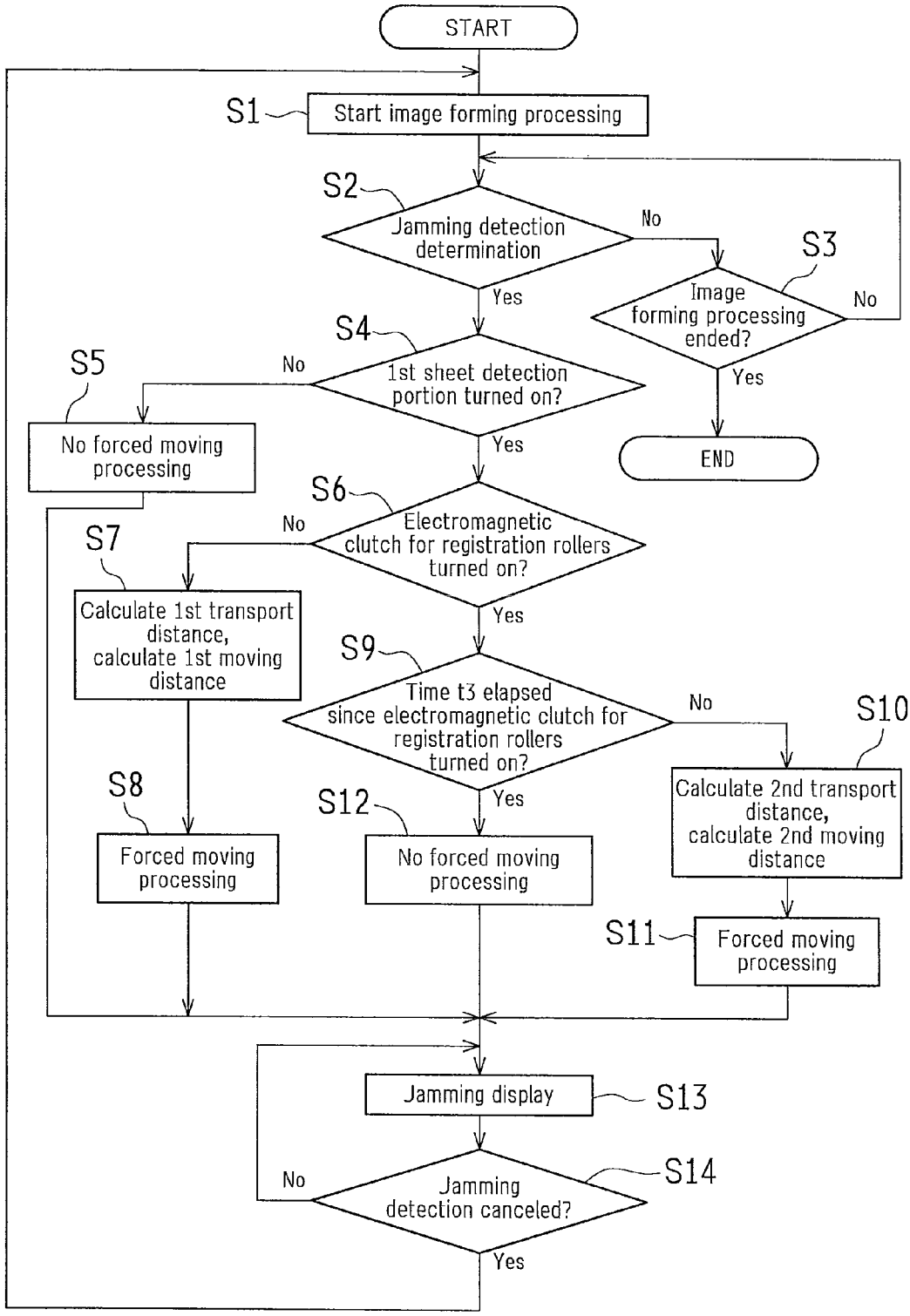
FIG. 12 is a flowchart showing an example of processing operations in the case where jamming has been detected during a printing operation of the image forming apparatus.
Figure 13A:
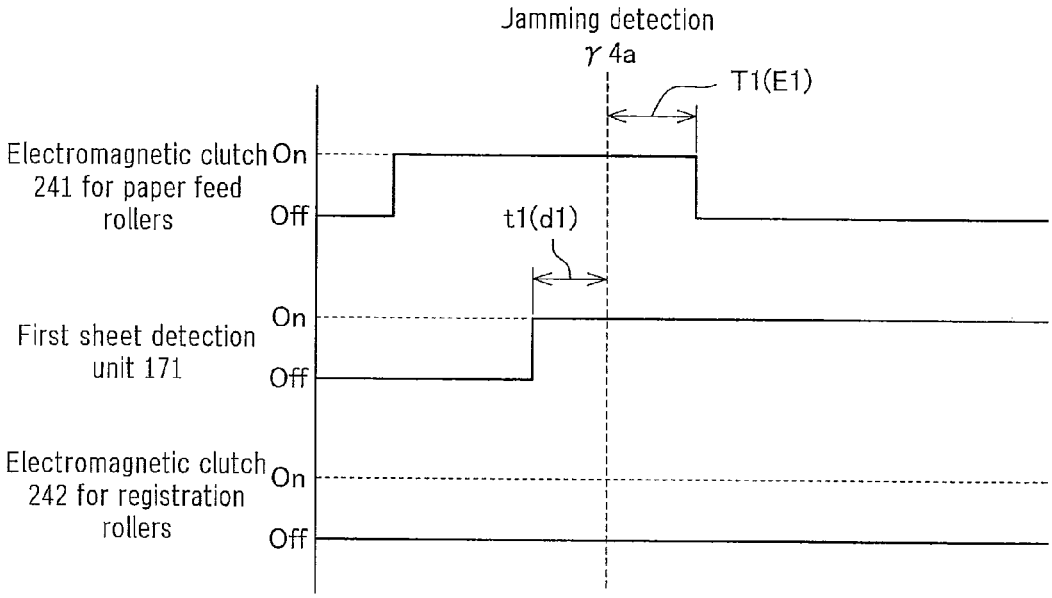
FIG. 13A is a timing chart showing an example of operation timing used in the processing operations shown in FIG. 12, in the case where the leading edge of a sheet is between the first reference detection position and the second reference detection position when jamming occurred.
Figure 13B:
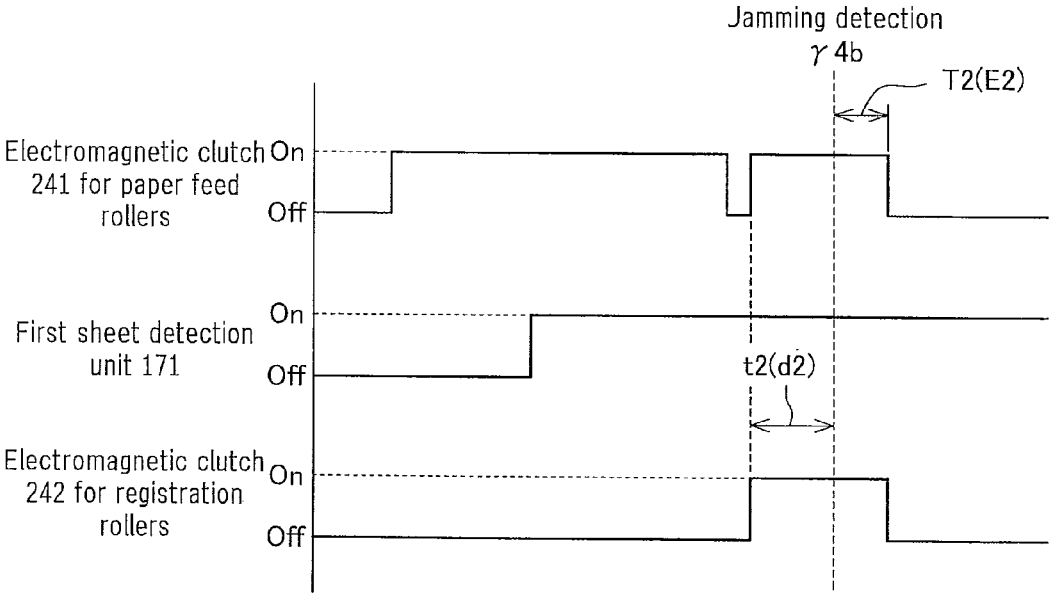
FIG. 13B is a timing chart showing an example of operation timing used in the processing operations shown in FIG. 12, in the case where the leading edge of a sheet is between the second reference detection position and the upstream side edge of the sheet removal job region in the sheet transport direction when jamming occurred.
Figure 14:
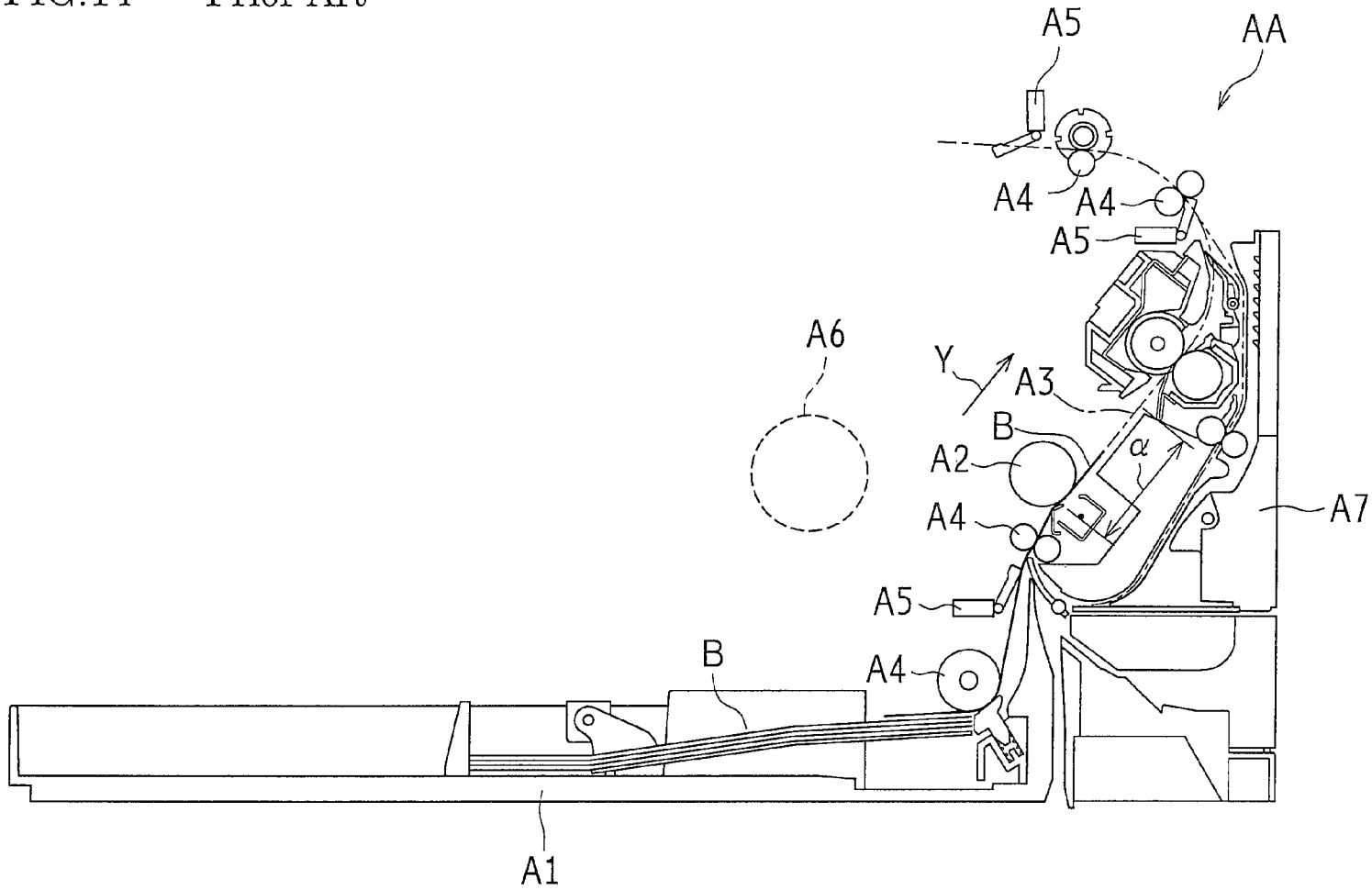
FIG.14 Prior Art
FIG. 14 is an illustrative diagram schematically showing the state in which a sheet is transported from a sheet storage portion toward a photosensitive drum in a conventional image forming apparatus.
Figure 15A:
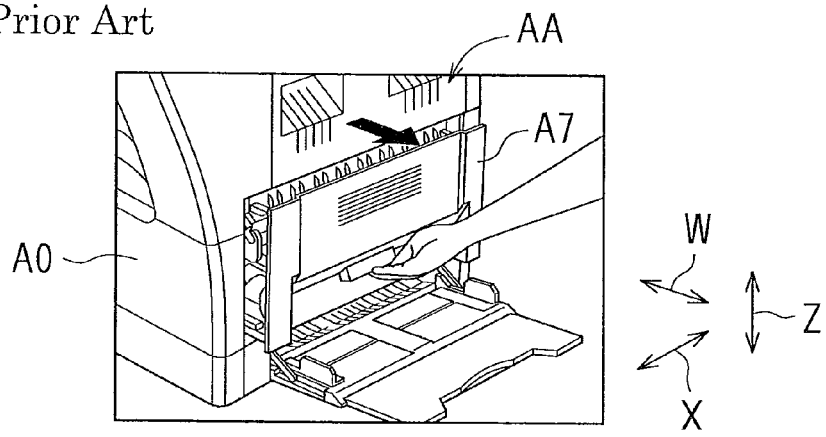
FIG.15A Prior Art
FIG. 15A is a schematic perspective diagram for describing a sheet removal job for removing a sheet that was motionless when jamming was detected, and shows the state during the release of an access cover.
Figure 15B:
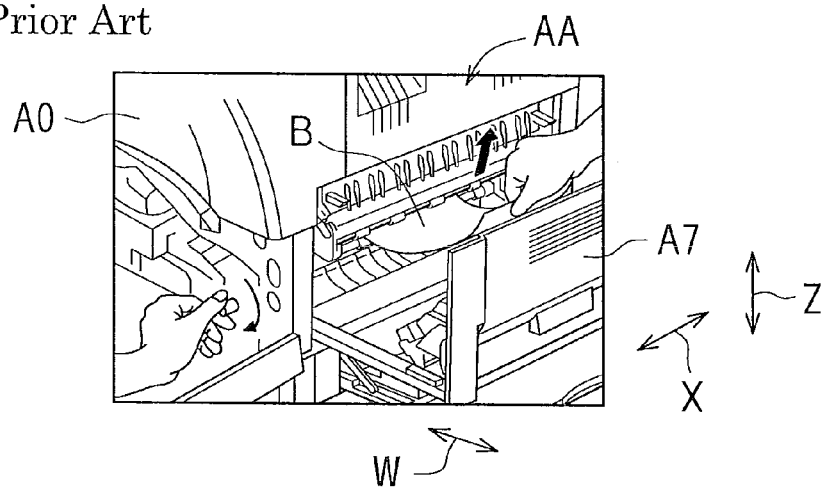
FIG.15B Prior Art
FIG. 15B is a schematic perspective diagram for describing the sheet removal job for removing a sheet that was motionless when jamming was detected, and shows the state in which the access cover is released and a sheet that was motionless when jamming was detected is being removed.
Figure 16:
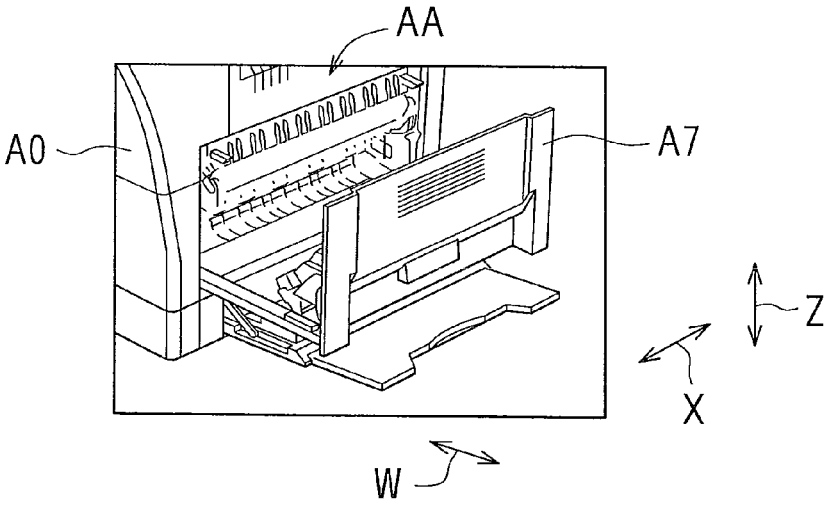
FIG.16 Prior Art
FIG. 16 is a schematic perspective diagram showing the state in which a sheet that was motionless when jamming was detected is not visible even when the access cover is released.

FIG. 12 is a flowchart showing an example of processing operations in the case where jamming has been detected during a printing operation of the image forming apparatus 100. Also, FIGS. 13A and 13B are timing charts showing an example of operation timing used in the processing operations shown in FIG. 12. FIG. 13A shows a timing chart in the case where the leading edge P1 of the sheet P is between the first reference detection position γ1 and the second reference detection position γ2 when jamming is detected, and FIG. 13B shows a timing chart in the case where the leading edge P1 of the sheet P is between the second reference detection position γ2 and the upstream side edge γ3 of the sheet removal job region α in the sheet transport direction Y when jamming is detected.

As shown in FIG. 12, in the image forming apparatus 100, after an image forming processing operation has started (step S1), a determination is made as to whether jamming was detected (step S2). The procedure moves to step S3 if it has been determined that jamming was not detected (No in step S2), and the procedure moves to step S4 if it has been determined that jamming was detected (Yes in step S2).

In step S3, it is determined whether the image forming processing operation has ended. The procedure moves to step S2 if the image forming processing operation continues to be performed (No is step S3), and the procedure is ended if the image forming processing operation has ended (Yes in step S3).

Also, in step S4, a determination is made as to whether the first sheet detection portion 171 turned on (whether a sheet P was detected at the first reference detection position γ1) (see FIG. 13A). If the first sheet detection portion 171 did not turn on (No in step S4), the sheet P can be easily removed from the paper feed portion 210 or the manual paper feed portion 270, and therefore the forced moving processing is not performed (step S5), and the procedure moves to step S13. If the first sheet detection portion 171 turned on (Yes in step S4), the procedure moves to step S6.

In step S6, a determination is made as to whether the electromagnetic clutch 242 for registration rollers turned on (whether the registration rollers 232 transported the sheet P) (see FIG. 13B). If the electromagnetic clutch 242 for registration rollers did not turn on (No in step S6), the leading edge P1 of the sheet P was located between the first reference detection position γ1 and the second reference detection position γ2 when jamming was detected, and therefore the first transport distance d1 (e.g., 10 mm) is calculated using the first jamming detection time t1 and the sheet P transport speed V, the first moving distance E1 (e.g., 117 mm) is calculated (see FIG. 7) by subtracting the calculated first transport distance d1 (e.g., 10 mm) from the first reference distance D1 (e.g., 127 mm) (step S7), and forced moving processing is performed by turning on the electromagnetic clutch 241 for paper feed rollers and rotationally driving the paper feed roller 231 for a first moving time T1 (1.17 sec=E1/V) corresponding to the first moving distance E1 (e.g., 117 mm) from the first jamming detection position γ4*a* (step S8), and thereafter the procedure moves to step S13.

On the other hand, if the electromagnetic clutch 242 for registration rollers turned on (Yes in step S6), a determination is made as to whether an on time t3 of the electromagnetic clutch 242 for registration rollers (e.g., 0.31=first distance D3 (e.g., 31 mm)/transport speed V (e.g., 100 mm/sec)) corresponding to the first distance D3 (e.g., 31 mm) has elapsed since when the electromagnetic clutch 242 for registration rollers turned on (step S9).

If the on time t3 has not elapsed in step S9 (No in step S9), the leading edge P1 of the sheet P was located between the second reference detection position γ2 and the upstream side edge γ3 of the sheet removal job region α in the sheet transport direction Y when jamming was detected, and therefore the second transport distance d2 (e.g., 20 mm) is calculated using the second jamming detection time t2 and the sheet P transport speed V, the second moving distance E2 (e.g., 91 mm) is calculated (see FIG. 8) by subtracting the calculated second transport distance d2 (e.g., 20 mm) from the second reference distance D2 (e.g., 111 mm) (step S10), and forced moving processing is performed by turning on the electromagnetic clutch 241 for paper feed rollers and the electromagnetic clutch 242 for registration rollers and rotationally driving the paper feed roller 231 and the registration rollers 232 for a second moving time T2 (0.91 sec=E2/V) corresponding to the second moving distance E2 (e.g., 91 mm) from the second jamming detection position γ4*b* (step S11), and thereafter the procedure moves to step S13.

On the other hand, if the on time t3 has elapsed in step S9 (Yes in step S9), the leading edge P1 of the sheet P had arrived at the sheet removal job region α when jamming was detected, and therefore the forced moving processing is performed (step S12), and the procedure moves to step S13. Note that the processing performed after the trailing edge P2 of the sheet P has passed the sheet removal job region α is processing corresponding to a sheet removal job region if a sheet removal job region is present thereafter.

In step S13, a jamming display for notifying the user that jamming occurred is displayed on a display panel of an operation portion (not shown) of the image forming apparatus 100, and in step S14 a determination is made as to whether jamming detection was canceled. If jamming detection has not been canceled (No in step S14), the procedure moves to step S13, and if jamming detection was canceled (Yes in step S14), the procedure moves to step S1, and the image forming processing operation is started again.

Note that although the configuration of the present invention is applied to a transport path from the top-level paper feed tray 211 to the photosensitive drum 11 in the sheet transport path 220 in the present embodiment, the configuration of the present invention may be applied to another transport path.

Also, although the configuration of the present invention is provided at a place where a sheet P on which an image is to be formed is transported in the present embodiment, an inconvenience related to original jamming can similarly be avoided even if the configuration of the present invention is provided at a place where an original from which an image is to be read is transported. Also, the configuration of the present invention can of course be applied to a color image forming apparatus as well.

The present invention can be embodied in various other forms without departing from the spirit or main features of the invention. The above-described embodiment is therefore merely exemplary in all respects, and is not intended to be interpreted in a limiting manner. The scope of the present invention is indicated by the scope of the claims, and is not intended to be restricted to this specification in any way. Furthermore, all variations and modifications within the scope equivalent to the scope of the claims are encompassed in the scope of the present invention.

What is claimed is:

1. An image forming apparatus comprising:

a sheet transport path that guides a sheet along a sheet transport direction;

a plurality of sheet transport rollers provided along the sheet transport path in order to transport the sheet in the sheet transport direction in the sheet transport path;

a driving portion that rotationally drives the sheet transport rollers;

a sheet detection portion that detects a transport time of the sheet that is transported in the sheet transport path by the sheet transport rollers that are rotationally driven by the driving portion; and a control portion that stops rotational driving of the sheet transport rollers by the driving portion in a case where jamming of the sheet has been detected using the transport time detected by the sheet detection portion, wherein a sheet removal job region for removal of the sheet that was motionless when the jamming was detected is provided in the sheet transport path, and the control portion comprises:

a sheet position detection unit that detects the position of the sheet in the sheet transport path in the sheet transport direction when the jamming was detected;

a forced moving processing unit that, in a case where the jamming is detected and rotational driving of the sheet transport rollers by the driving portion is stopped, based on the position of the sheet in the sheet transport path in the sheet transport direction that was detected by the sheet position detection unit, performs forced moving processing in which the sheet is transported so as to forcibly move the sheet to sheet removal position at which at least part of the sheet is located in the sheet removal job region; and a forced moving processing determination unit that determines whether the forced moving processing is to be performed by the forced moving processing unit in accordance with the position of the sheet in the sheet transport path in the sheet transport direction that was detected by the sheet position detection unit, wherein in a case of performing a consecutive image forming operation for consecutively performing image formation on a plurality of the sheets, when the sheet is to be transported in the sheet transport direction toward the sheet removal position in the forced moving processing performed by the forced moving processing unit, the sheet removal position is set to a position at which a downstream side edge of the sheet in the sheet transport direction is disposed on the upstream side of an upstream side edge in the sheet transport direction of a nearest sheet that is motionless ahead of the sheet.

2. An image forming apparatus comprising:

a sheet transport path that guides a sheet along a sheet transport direction;

a plurality of sheet transport rollers provided along the sheet transport path in order to transport the sheet in the sheet transport direction in the sheet transport path;

a driving portion that rotationally drives the sheet transport rollers;

a sheet detection portion that detects a transport time of the sheet that is transported in the sheet transport path by the sheet transport rollers that are rotationally driven by the driving portion; and a control portion that stops rotational driving of the sheet transport rollers by the driving portion in a case where jamming of the sheet has been detected using the transport time detected by the sheet detection portion, wherein a sheet removal job region for removal of the sheet that was motionless when the jamming was detected is provided in the sheet transport path, and the control portion comprises:

a sheet position detection unit that detects the position of the sheet in the sheet transport path in the sheet transport direction when the jamming was detected;

a forced moving processing unit that, in a case where the jamming is detected and rotational driving of the sheet transport rollers by the driving portion is stopped, based on the position of the sheet in the sheet transport path in the sheet transport direction that was detected by the sheet position detection unit, performs forced moving processing in which the sheet is transported so as to forcibly move the sheet to a sheet removal position at which at least part of the sheet is located in the sheet removal job region; and a forced moving processing determination unit that determines whether the forced moving processing is to be performed by the forced moving processing unit in accordance with the position of the sheet in the sheet transport path in the sheet transport direction that was detected by the sheet position detection unit, wherein the sheet position detection unit detects the position of the sheet in the sheet transport path in the sheet transport direction based on a transport distance of the sheet calculated using a jamming detection time that is from a detection time at a reference detection position to the time when the jamming was detected, the reference detection position serving as a reference detection position of the transported sheet on the upstream side of the sheet removal job region in the sheet transport path.

3. The image forming apparatus according to claim 2, wherein the forced moving processing unit forcibly moves the sheet a moving distance obtained by subtracting the transport distance from a reference distance that is from the reference detection position to the sheet removal position.

4. The image forming apparatus according to claim 2, wherein a first reference detection position at which the sheet is detected on the upstream side of the sheet removal job region in the sheet transport direction, and a second reference detection position at which the sheet is detected between the first reference detection position and the sheet removal job region are included as the reference detection position, the forced moving processing determination unit determines that the forced moving processing is not to be performed by the forced moving processing unit in a case where the jamming was detected before a downstream side edge of the sheet in the sheet transport direction arrives at the first reference detection position, the forced moving processing determination unit determines that the sheet is to be transported toward the sheet removal position in the sheet transport direction in the forced moving processing performed by the forced moving processing unit in a case where the jamming was detected before the downstream side edge of the sheet in the sheet transport direction arrives at a pre-set setting position that is between the first reference detection position and an upstream side edge of the sheet removal job region in the sheet transport direction, and the forced moving processing determination determines that the forced moving processing is not to be performed by the forced moving processing unit in a case where the jamming was detected at a time that is after the downstream side edge of the sheet in the sheet transport direction arrived at the upstream side edge of the sheet removal job region in the sheet transport direction and before an upstream side edge of the sheet in the sheet transport direction passes the sheet removal job region.

5. The image forming apparatus according to claim 4, wherein in a case where the jamming was detected at a time that is after the sheet arrived at the first reference detection position and before the sheet arrives at the second reference detection position, the forced moving processing unit forcibly moves the sheet a first moving distance obtained by subtracting a first transport distance from a first reference distance, the first transport distance being calculated using a first jamming detection time that is from a detection time at the first reference detection position to the time when the jamming was detected, and the first reference distance being from the first reference detection position to the sheet removal position, and in a case where the jamming was detected at a time that is after the sheet arrived at the second reference detection position and before the sheet arrives at the setting position, the forced moving processing unit forcibly moves the sheet a second moving distance obtained by subtracting a second transport distance from a second reference distance, the second transport distance being calculated using a second jamming detection time that is from a detection time at the second reference detection position to the time when the jamming was detected, and the second reference distance being from the second reference detection position to the sheet removal position.

6. The image forming apparatus according to claim 4, further comprising:

a sheet storage portion that is disposed on the upstream side of the sheet transport path in the sheet transport direction and stores a plurality of the sheets, wherein included among the plurality of sheet transport rollers are a first transport roller that is disposed on the upstream side of the first reference detection position in the sheet transport direction and supplies the sheets stored in the sheet storage portion one-by-one toward the first reference detection position, and a second sheet transport roller that transports the sheets detected at the second reference detection position.

7. The image forming apparatus according to claim 6, further comprising:

an opposing sheet storage portion that is provided opposing the sheet storage portion on the first sheet transport roller side in a width direction that is orthogonal to an axial direction of the sheet transport rollers and a vertical direction, wherein the sheet transport path has a transport path that guides the sheets from the sheet storage portion and the opposing sheet storage portion toward one side in the vertical direction, and the sheet removal job region is provided in the vicinity of the sheet storage portion and the opposing sheet storage portion on the downstream side thereof in the sheet transport direction.

8. The image forming apparatus according to claim 6, wherein the sheet storage portion is provided so as to be capable of being inserted into and removed from an apparatus main body of the image forming apparatus along an axial direction of the sheet transport rollers.

9. The image forming apparatus according to claim 6, wherein when the second sheet transport roller is rotationally driven, the first sheet transport roller is also rotationally driven, and in a case where the size of the sheet in the sheet transport direction is smaller than a pre-set first setting size, the forced moving processing unit changes the sheet removal position according to the size of the sheet in the transport direction.

10. The image forming apparatus according to claim 6, wherein when the second sheet transport roller is rotationally driven, the first sheet transport roller is also rotationally driven, and in a case where the size of the sheet in the sheet transport direction is smaller than a pre-set second setting size, the forced moving processing unit determines that the forced moving processing is not to be performed by the forced mobbing processing unit.

* * * * *